US007497769B2

(12) United States Patent
Abe et al.

(10) Patent No.: US 7,497,769 B2
(45) Date of Patent: Mar. 3, 2009

(54) COIN HOPPER

(75) Inventors: Hiroshi Abe, Iwatsuki (JP); Takashi Inozuka, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 370 days.

(21) Appl. No.: 11/008,866

(22) Filed: Dec. 10, 2004

(65) Prior Publication Data

US 2005/0153646 A1 Jul. 14, 2005

(30) Foreign Application Priority Data

Dec. 12, 2003 (JP) ..... 2003-414354
Aug. 27, 2004 (JP) ..... 2004-247722

(51) Int. Cl.
*G07D 1/00* (2006.01)

(52) U.S. Cl. ..... 453/29; 453/49; 453/57; 221/203

(58) Field of Classification Search ..... 453/18, 453/29, 30, 32, 33, 34, 35, 49, 57
See application file for complete search history.

(56) References Cited

U.S. PATENT DOCUMENTS

| | | | | |
|---|---|---|---|---|
| 2,848,158 | A * | 8/1958 | Miller | 235/32 |
| 3,942,544 | A | 3/1976 | Breitenstein et al. | |
| 4,036,242 | A | 7/1977 | Breitenstein et al. | |
| 4,798,558 | A * | 1/1989 | Bellis | 453/32 |
| 4,923,430 | A * | 5/1990 | Iimura | 453/50 |
| 5,098,339 | A * | 3/1992 | Dabrowski | 453/30 |
| 5,098,340 | A * | 3/1992 | Abe | 453/57 |
| 5,163,868 | A * | 11/1992 | Adams et al. | 453/11 |
| 5,190,495 | A * | 3/1993 | Taxon | 453/32 |
| 5,525,104 | A * | 6/1996 | Adams et al. | 453/10 |
| 6,193,598 | B1 * | 2/2001 | Tsuchida | 453/57 |
| 6,328,646 | B1 * | 12/2001 | Abe et al. | 453/56 |
| 6,350,192 | B1 * | 2/2002 | Kibihara | 453/50 |
| 6,350,193 | B1 * | 2/2002 | Paulsen | 453/57 |
| 6,398,637 | B1 * | 6/2002 | Tsuchida | 453/57 |
| 2005/0014462 | A1 * | 1/2005 | Suverein et al. | 453/29 |

FOREIGN PATENT DOCUMENTS

EP 0.311.320 A2 * 4/1989

* cited by examiner

*Primary Examiner*—Patrick Mackey
*Assistant Examiner*—Mark Beauchaine

(57) ABSTRACT

The invention promotes a smooth agitation and efficient transport of coins by setting the rotation direction of the agitator in the same direction as the rotary disc to move a center of rotation of the agitator to a location where most coins are collected.

16 Claims, 16 Drawing Sheets

COIN HOPPER

FIELD OF THE INVENTION

The present invention relates to a coin hopper which is used for dispensing coins stored in a coin bowl in bulk. Incidentally, the coins include official currency coins, substitute coins such as medals and tokens for game machines, and similar coins.

BACKGROUND OF THE INVENTION

Conventionally, various types of apparatus are known as apparatus for dispensing disc-like coins.

For example, it is known to disclose a hopper apparatus in which a stack wheel is provided on a front of a top section of a pinwheel, a plurality of pins are provided on the circumference of the pinwheel between a circumferential section of the pinwheel and a circumferential section of the stack wheel in a radial manner. Furthermore an agitator which has three projections is anchored on a central section of the stack wheel to agitate the coins in the hopper.

This apparatus is constituted in such a manner that the pinwheel, the stack wheel, and the agitator are mutually integrally rotated with a cone-like body with the result that the apparatus is rotated in the hopper in the same direction with the same number of rotations.

At first, the coins reach a groove within the hopper. Since the pinwheel and elements associated with the pinwheel are arranged at a certain angle, coins are moved into the groove. Thereafter, the coins are agitated with the agitator, and are engaged with an outer pin of the pinwheel. Coins can form a mutually stacked posture until the coins reach a position corresponding to two o'clock of a clock.

A wiper is engaged with any coins which are stacked to sweep down the coins into the hopper. The coins which pass above a top section of the stack wheel are engaged with a knife to separate the coin for release. Thereafter, the coins proceed by crossing the knife. Then, the coins are discharged into an exhaust chute in an accelerated manner. The chute has a coin deflector which is engaged with coins to deflect the coins toward the center. Thereafter, the coins are discharged freely to an outer tray.

The knife is mounted on a axis in such a manner that an attachment position thereof can be freely adjusted. Consequently, a stack plate having a desired diameter and the agitator can be located on the pinwheel so as to accommodate coins having different sizes.

The prior art further discloses that a supply ring and an agitator can be rotated in a direction opposite to each other by starting the drive motor in the state in which the coins are accommodated in an irregular manner with the result that coins which are fixed to the inner surface of the supply ring are picked up with a coin supply claw and a fixed vertical support plate while agitating the coins in the hopper so that the coins are sent to a coin dispensing opening located above while applying a pressing force to the surface.

In particular, this apparatus is intended to improve the picking up of coins in the hopper with the supply ring, and the device comprises a plate-like agitating member having a plurality of radial arms made of synthetic rubber which is fixed with a pressure plate and a screw on a disc so that the plate-like agitating member is projected from the front side surface of the support plate by locating the disc in a disc hole formed on a vertical support plate at a position corresponding to the lower half section inside of the supply ring.

Consequently, the coins are agitated with the agitator which is rotated reversely with respect to the supply ring in the hopper, so that coins can be efficiently picked up with the supply jaw of the supply ring.

In the first prior art, as the coins are moved to the side of the rotation direction of the pinwheel while being agitated with the agitator, the movement of the coins becomes slow at positions corresponding, for example, to a direction of 6 to 5 o'clock or 4 o'clock of a dial of a clock as seen from the front surface, so that many coins tend to be concentrated at those positions.

At locations where the movement of the coins becomes slow, the movement of the coins starts to conflict with each other with the result that the coins are not introduced into the coin transport passage Pa comprising a pinwheel and a stack wheel whereby coins move in a mutually opposite direction with the result that an idle state is generated.

As a consequence, in the coin transport passage Pa, an irregular dispensing of the coins is generated, and an idle dispensing of the coins is generated with the result that the dispensing efficiency is poor and an accurate dispensing of the predetermined coin count cannot be conducted.

Furthermore, the agitator cannot go so far as to agitate the coins in the vicinity of the bottom section of the hopper because the shaft core of the output shaft is rotatably supported on the center of the hopper. Thus, the agitation efficiency is further deteriorated.

Furthermore, with respect to this apparatus, it is required that adjustment parts such as a wiper and a knife are required to be arranged as a countermeasure for maintaining a separation of the coins in the dispensing track of the coins and a stable dispensing posture of coins as a countermeasure for preventing the joggling of coins in the dispensing output. For this reason, the number of parts can become large, so that the cost is increased while an adjustment of the wiper and the knife is required every time the stack wheel is exchanged with the result that it takes a long time to manufacture and assemble the machine and the work thereof is very troublesome.

Furthermore, the stack wheel of this machine is rotatably and exchangeably provided on the tip section of the pinwheel. In accordance with the size of the coins to be applied, the stack wheel must have a size of a diameter with a predetermined relation with the diameter of the pinwheel.

However, the pinwheel is fixed to the stack wheel which can be exchanged and the pins which are provided thereon are arranged in a definite distance.

Consequently, in the case where the stack wheel is exchanged in correspondence to the size of the coins, a shift is generated in a position relationship with respect to the pins for the coin which is delivered between the stack wheel and the pins with the result that an irregular dispensing of the coins is generated or the dispensing of the coins becomes unstable.

In the second prior art, since the coins are pressed with the pressure force with the supply claw of the supply ring and the pressure of the plate-like agitating member of the agitator which is reversely rotated for agitation, the coins provide a large friction and resistance factor with respect to the agitator which has a larger number of revolutions than the supplying ring has and which is reversely rotated so that agitating member may wear and the life of the member itself is shortened, and the coins themselves are damaged by the agitating member.

Furthermore, there is also a problem in that the agitating member must be exchangeable in a short time period.

SUMMARY OF THE INVENTION

The present invention has been made to solve the aforementioned problems.

A first object of the invention is to provide a coin hopper which efficiently collects the coins, and can dispense the coins.

A second object of the present invention is to provide a coin hopper which is free from the generation of joggling of the coins.

Furthermore, a third object of the present invention is to provide a coin hopper in which the application scope to accommodate different coin sizes is widened.

The coin hopper according to the present invention comprises a hopper bowl for storing coins in a bulk stacked state, a rotary disc for receiving and dispensing coins in the hopper bowl one by one between a plurality of coin anchors which are inclined in an upward direction at a predetermined angle and are arranged at a predetermined distance, a fixed guide which has a smaller diameter than the rotary disc and has a concentric configuration with the rotary disc and which is projected in a predetermined amount toward the hopper bowl of the rotary disc, and an agitator which is projected in a predetermined amount toward the hopper bowl greater than the fixed guide and is located on a lower side with respect to the rotation shaft of the rotary disc.

According to the present invention, the coins are agitated in association with the rotation of the rotary disc by placing the agitator at a position which is moved in a downward direction with respect to the center of the rotation which is formed by the rotation disc. Consequently, the coins on the bottom section of the hopper bowl can be efficiently agitated. Furthermore, the coins can be agitated with the agitator at a location where many of the coins are concentrated with the same rotation of the agitator and the rotary disc with the result that the coins can be efficiently picked up to be introduced and transferred into the coin movement passage which comprises a rotary disc and the fixed guide.

The coins which are anchored to the anchor of the rotary disc are moved to the dispensing port while being guided to the circumference of the fixed guide. Consequently, the knife is not so that the adjustment thereof at the time of the change of the coin diameter is not required and the number of parts can be decreased, which leads to a cost reduction.

Furthermore, an idle transport of the coins into the coin transport passage and an irregular transport of coins as seen with a conventional machine is avoided, and the transport efficiency can be largely improved.

The set position of a coin sensor can be changed to fit to the specific diameter of the coins, and the rotary disc and the fixed guide can be changed to be fit to the diameter of the coins with the result that the scope of the coins to be dispensed can be widened.

Furthermore, the agitator can be rotated on an axis which forms a different rotation center at a lower position of rotation center of the rotary disc. Consequently, the agitator can be rotated at a rotation number different from that of the rotary disc or in a rotation direction different from that of the rotary disc with the result that the agitation efficiency and the transport efficiency of the coins can be improved.

A pressure force is applied to the coins between the plurality of arms to activate the movement of the coins thereby moving the coins. Consequently, at a location where many coins are collected, these coins are agitated to rotate their posture and position at random with the result that many coins can be moved to the coin transport passage.

Furthermore, the friction resistance at the time of the contact between the coins and the agitator is alleviated, and the agitator is rotated in the same direction as the rotary disc with the result that any abrasion of the agitator is suppressed and the endurance life of the part thereof can be prolonged.

The coins which are transported to the coin transport passage are arranged in a row while holding a stable posture for each of the coins, and the coins are guided to the side of the coin transport port so that the coins can be smoothly delivered.

Furthermore, the transport posture of the coins can be stabilized and can endure any friction particularly resulting from the contact of the metal-made coins.

Furthermore, the part can be exchanged with a piece corresponding to the coins and the worn part can be exchanged with a new piece.

The coins which move into the horizontal coin transport guide can be dispensed toward the coin sensor, one by one, by the dispensing roller with the result that the joggling of the coins in the chute can be prevented, and the counting and dispensing of the coins can be performed quickly and accurately.

Furthermore, the coin sensor is not projected toward the coin transport passage, so that there is no direct physical effect given by the joggling of the coins which may be generated in the coin transport passage thereby enabling the breakage of the coin sensor.

The coins do not interfere with the coin sensor between the coin sensor and the dispensing roller by providing an appropriate distance between the coin sensor and the dispensing roller. Consequently, an erroneous operation of the coin sensor by the coins can be prevented so that the coins can be counted accurately.

Furthermore, since the unallowable coins blocking piece is arranged in the coins transport passage, unallowable coins having a large diameter are blocked away from the transport passage with the blocking piece. Consequently, the unallowable coins are blocked and the unallowable coins do not move into the chute. Therefore, the joggling of the coins in the chute can be prevented in advance.

Furthermore, the coin sensor can be moved and adjusted together with the unallowable coins blocking piece in a direction perpendicular to the coin transport passage in correspondence to the diameter of the coins with the result that the coins can be accurately counted and the coin sensor and the coins do not interfere with each other in the chute.

A power transmission system can be constituted in which the agitator is rotated with a first transmission gear which is engaged with the drive gear, and the rotary disc is rotated in the same direction gear which is engaged with a second transmission gear which is integrally formed on the first transmission gear. Consequently, the agitation efficiency of the coins and the transport efficiency of the coins can be improved with a compact structure.

Furthermore, the coins can be efficiently and smoothly transported in correspondence to different size coins by appropriately exchanging and assembling an appropriate rotary disc and the fixed guide which correspond to the coins. as a consequence, the prior art disadvantage in the transport of the coins such as the irregular transport of the coins or the like resulting from a shift in position between the coins and the pins as a result of the change in the coin size is avoided.

DESCRIPTION OF THE PREFERRED EMBODIMENT

A hopper bowl for storing coins in a bulk stacked state is provided on a base and a rotary disc having a plurality of anchors which are arranged in a predetermined distance, a fixed guide which is arranged on the rotary disc and which has a smaller diameter than the rotary disc and has a concentric configuration and is projected in an appropriate thickness, and an agitator which is projected to the hopper bowl than the fixed guide in a predetermined amount to agitate coins in the hopper bowl in bulk stacked state to discharge the coins efficiently.

Embodiment 1

Hereinafter, forms of embodying the coin hopper according to the present invention will be explained in detail by referring to drawings on the embodiments.

Figure 1:
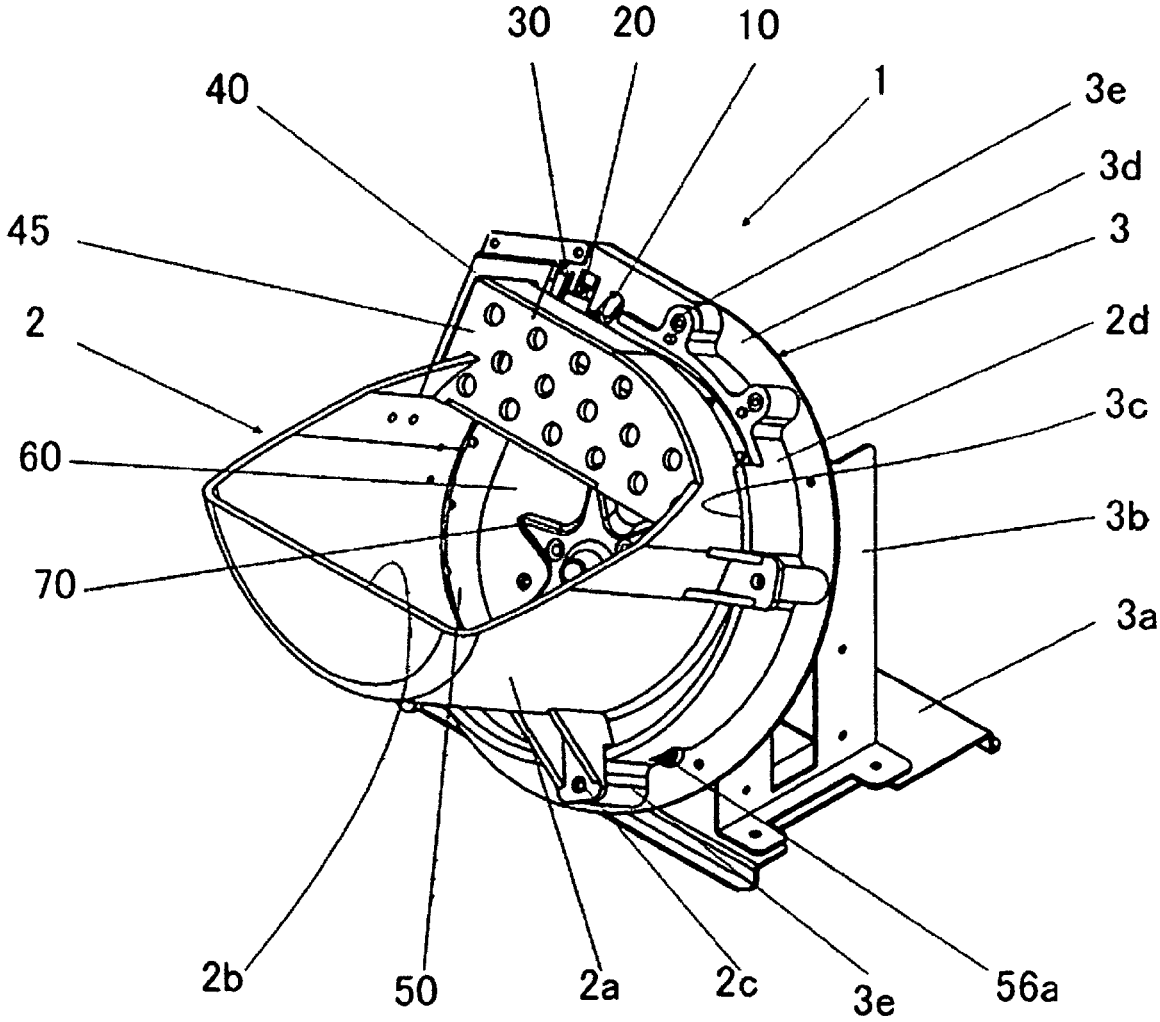
FIG. 1 is s perspective view showing a coin hopper according to Embodiment 1 of the present invention.
Figure 2:
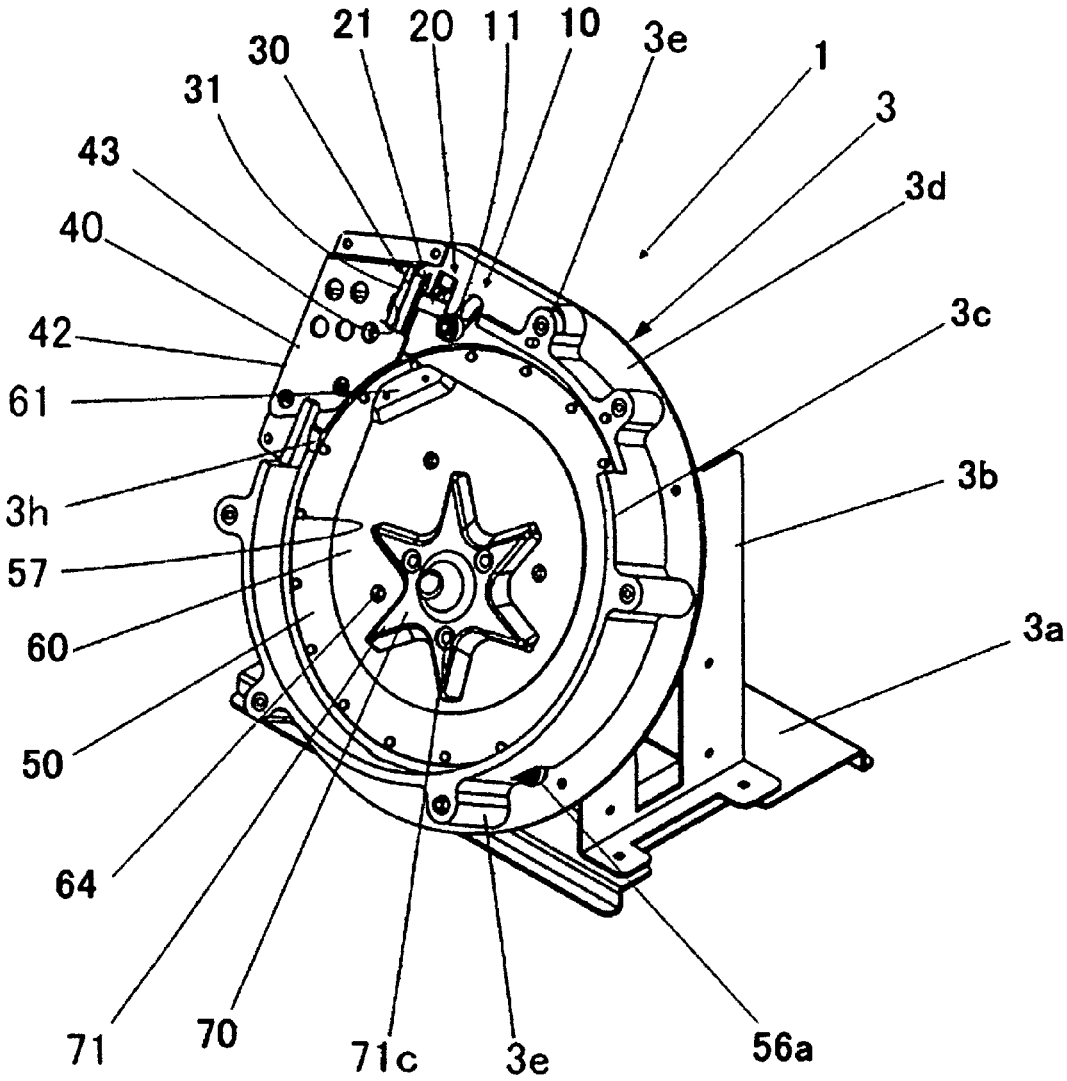
FIG. 2 is a perspective view showing a state in which the hopper bowl according to Embodiment 1 of FIG. 1 is detached.

FIG. 1 is a perspective view showing a perspective of the coin hopper according to Embodiment 1 of the present invention.

As shown in FIG. 1, the coin hopper 1 according to Embodiment 1 of the present invention has a hopper bowl 2 for storing a plurality of coins in a bulk stacked state, and a main body 3 of the hopper for supporting and fixing the hopper bowl 2 in an upwardly inclined state.

Furthermore, the hopper bowl 2 has a hopper head section 2*a* which is projected in a forward direction from the main body 3 of the hopper and has a configuration having an increasing deepness and being inclined toward the agitator 70, a coin inlet port 2*b* for receiving the coins in an upward direction, a projection section 2*c* for the attachment and fixture on the main body 3 of the hopper 3, and an fitting body section 2*d* for fitting on the main body 3 of the hopper.

Furthermore, the main body 3 of the hopper has a horizontal placement base section 3*a*, a support side wall section 3*b* which is erected approximately vertically with respect to the placement base 3*a*, a ring-like fitting section 3*c* for receiving the fitting body section 2*d*, and a base section 3*d* which is integrally formed on the ring-like fitting section 3*c*, and a hopper bowl attaching section 3*e* which is integrally formed on the ring-like fitting section 3*c*. The main body 3 of the hopper is fixed in an inclined manner in an upward direction via the base section 3*d* to the support side wall section 3*b*.

On the main body 3 of the hopper, there are provided a dispensing roller attaching section 10, an unallowable coins blocking piece 20, a coin sensor attaching section 30, a chute 40, and a coin cover 45 at a location on the upper left as seen in the drawings. There are provided a rotary disc 50, a fixed guide 60, and an agitator 70 respectively over the bottom portion of the hopper bowl 2 toward the forward direction at the central position as seen from the surface of the drawings.

The coin hopper 1 will be described in detail by using FIGS. 2 to 10. On the main body 3 of the hopper, a ring-like jaw section 3*g* I is integrally formed on the lower section of the inner circumferential side wall 3*f* for forming the ring-like engaging section 3*c* at a location in the vicinity of the center as seen in the drawings.

Figure 7:
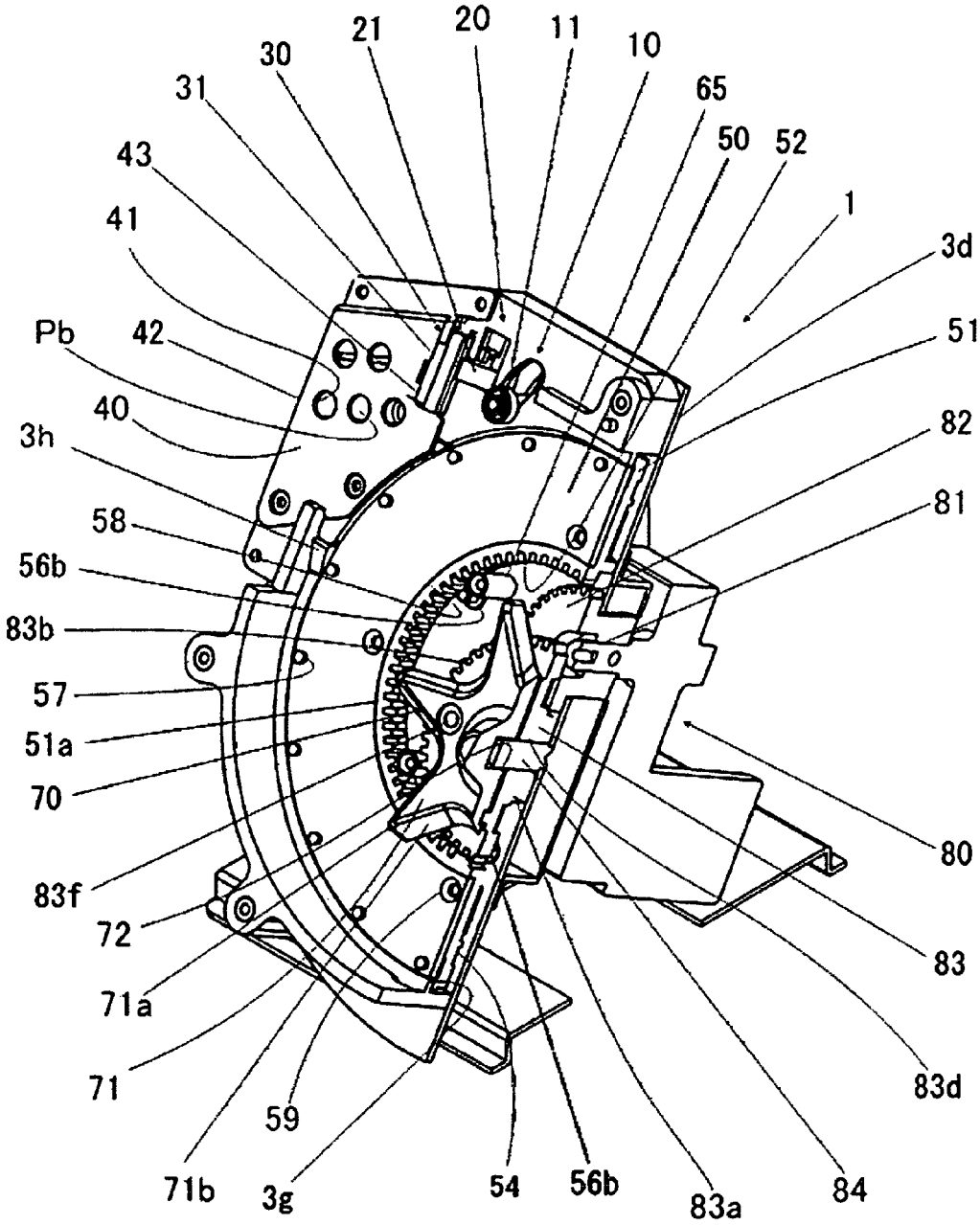
FIG. 7 is a perspective view of a central vertical cross section.

This ring-like jaw section 3*g* is provided for supporting an outer circumference of the upper surface of the rotary 51 which is inserted between the section 3*g* and the base section 3*d*, and which is shown in FIG. 7.

Furthermore, as shown in FIG. 7, on the surface of the ring-like jaw section 3*d*, there are arranged a piece 3*h* for preventing the coins from jumping the hopper. The piece 3*h* for preventing the coins from jumping the hopper is located at a position a little above the rotation center P of the rotary disc 50. The upper surface of the piece 3*h* is located at an approximately vertical position with respect to the placement base section 3*a*. The surface thereof is extended from the surface of the ring-like jaw section 3*a* toward the chute 40 at an angle looking in an upward direction. The coins are allowed to float from the rotary disc 50 to fall into the lower hopper bowl 2. In the case where the coins move to the side of the chute along the inner circumferential side wall 3*f*, the coins are erected with this upper surface to allow the coins to fall into the hopper bowl 2 thereby preventing the coins from being stacked between the chute 40 and the coin anchor pin 57.

Incidentally, for the coin anchor pin 57, an anchor member such as a plate or the like may be used instead of the pin. Consequently, the coin anchor pin 57 may be described as an anchor body 57.

Furthermore, on a coin passage from the rotary disc 50 to the chute 40, a dispensing roller attaching section 10, an unallowable coins blocking piece attaching section 20, and a coin sensor attaching section 30 are arranged from the side of the disc 50. On the dispensing roller attaching section 10, a dispensing roller 11 is attached. On the unallowable coin attaching section 20, the unallowable coin blocking piece 21 is attached. On the coin sensor attaching section 30, a coin sensor 31 is movably attached. In particular, the unallowable coins blocking piece 21 and the coin sensor 31 are attached so that the two elements can be moved in a mutually associated manner.

Figure 3:
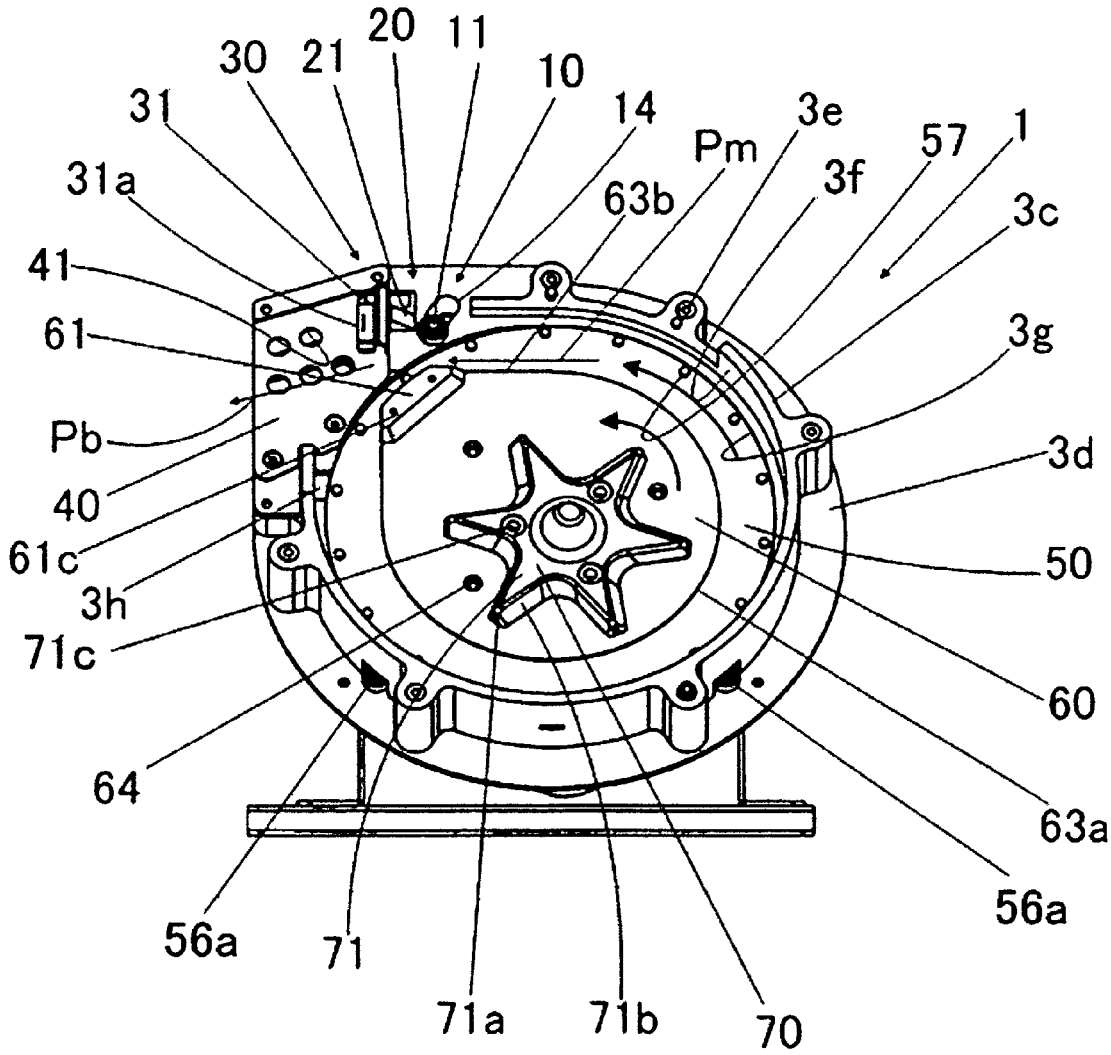
FIG. 3 is a front view of FIG. 2.

Similarly, the chute 40 on the left view of the drawing is formed in a cross section channel configuration. The inside surface 41 of the chute 40 and the upper surface of the base section 3*d* of the main body 3 of the hopper has a cross section having a rectangular configuration. as shown in FIG. 3, a coin transport passage Pb is formed which is inclined in a downward direction.

The unallowable coins blocking piece 21 is such that an inclined surface is formed which is projected at an angle looking toward an inclined upward direction on the side of the chute 40 from the upper surface of the rotary disc 50. In other words, the piece 21 has an approximately right angle triangle configuration. The inclined surface is faced upward toward the chute 40 from the upper surface of the base section 3*d*. The piece 21 is fixed to slightly an outer portion of the passage of the allowed coins. The unallowable coins which are transported from the upstream coin delivering passage Pm and which have diameters which prevents the movement to the chute 40 are allowed to float from the rotary disc 50 to fall into the hopper bowl 2.

In the drawings, on the chute 40 a coin sensor 31 is formed which is integrally connected to the unallowable coins blocking piece 21. A coin transport passage Pb is formed with the inside surface 41 and the upper surface of the base section 3*b*. The chute 40 forms a metal-made lid configuration formed of a steel plate which is bent with plate processing or the like which has a notch 43 provided over a section at which the coin sensor 31 and, the unallowable coins blocking piece are moved. The left end of the passage Pb is a dispensing port 42.

The coin sensor 31 is provided at a position recessed from the inner surface 41 of the chute and the upper surface of the base section 3*d*, so that the coin sensor 31 is not projected into the coin transport passage Pb and is arranged in such a manner that an appropriate distance is provided with respect to the dispensing roller 11.

Furthermore, the coin sensor 31 is provided in such a manner that the coin sensor 31 can be moved in a direction perpendicular to the coin transport passage Pm together with the unallowable coins blocking piece 21 between the dispensing roller 11 and the chute 40.

Figure 15:
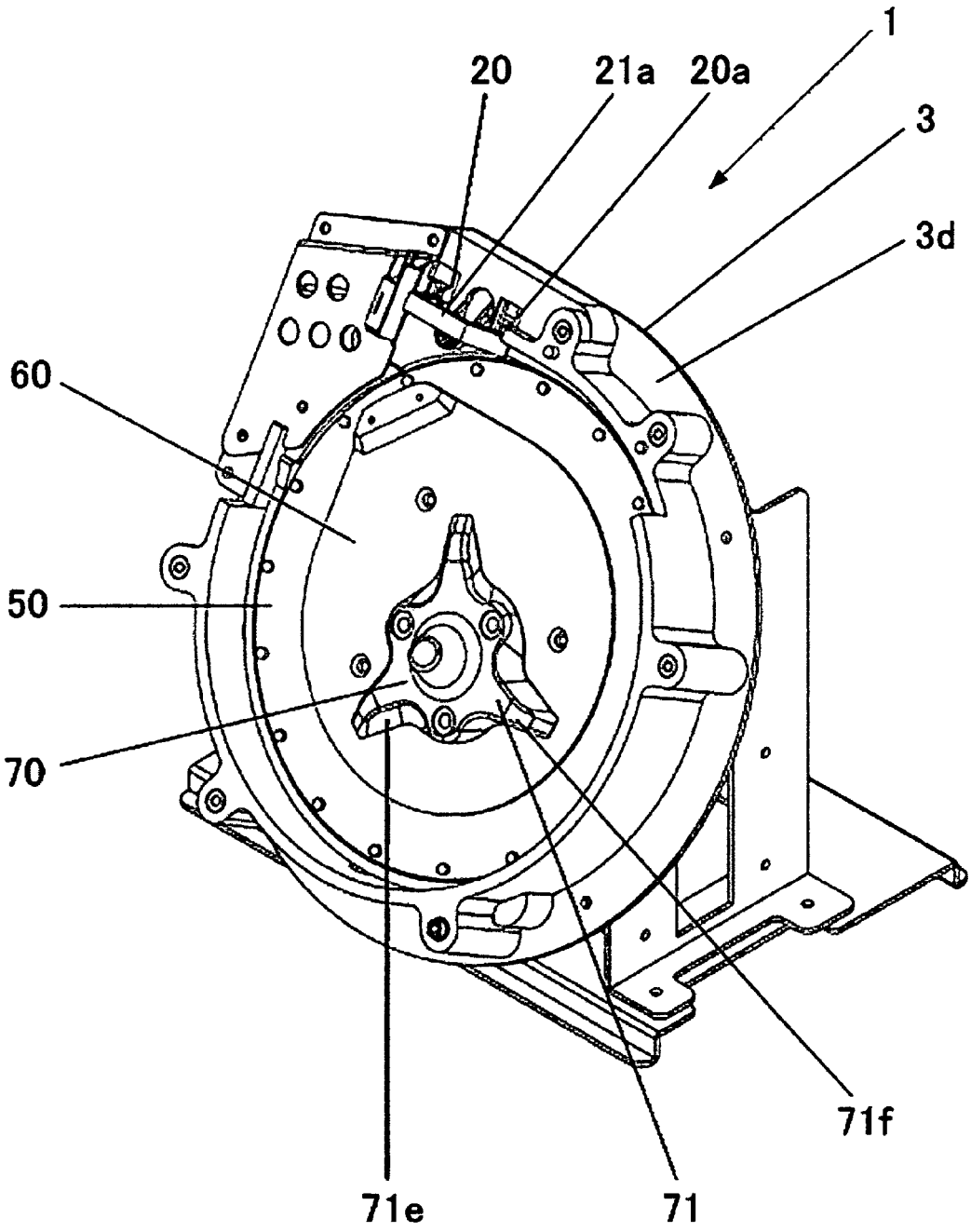
FIG. 15 is a front view showing another structure of the agitator and the unallowable coins blocking piece.
Figure 16:
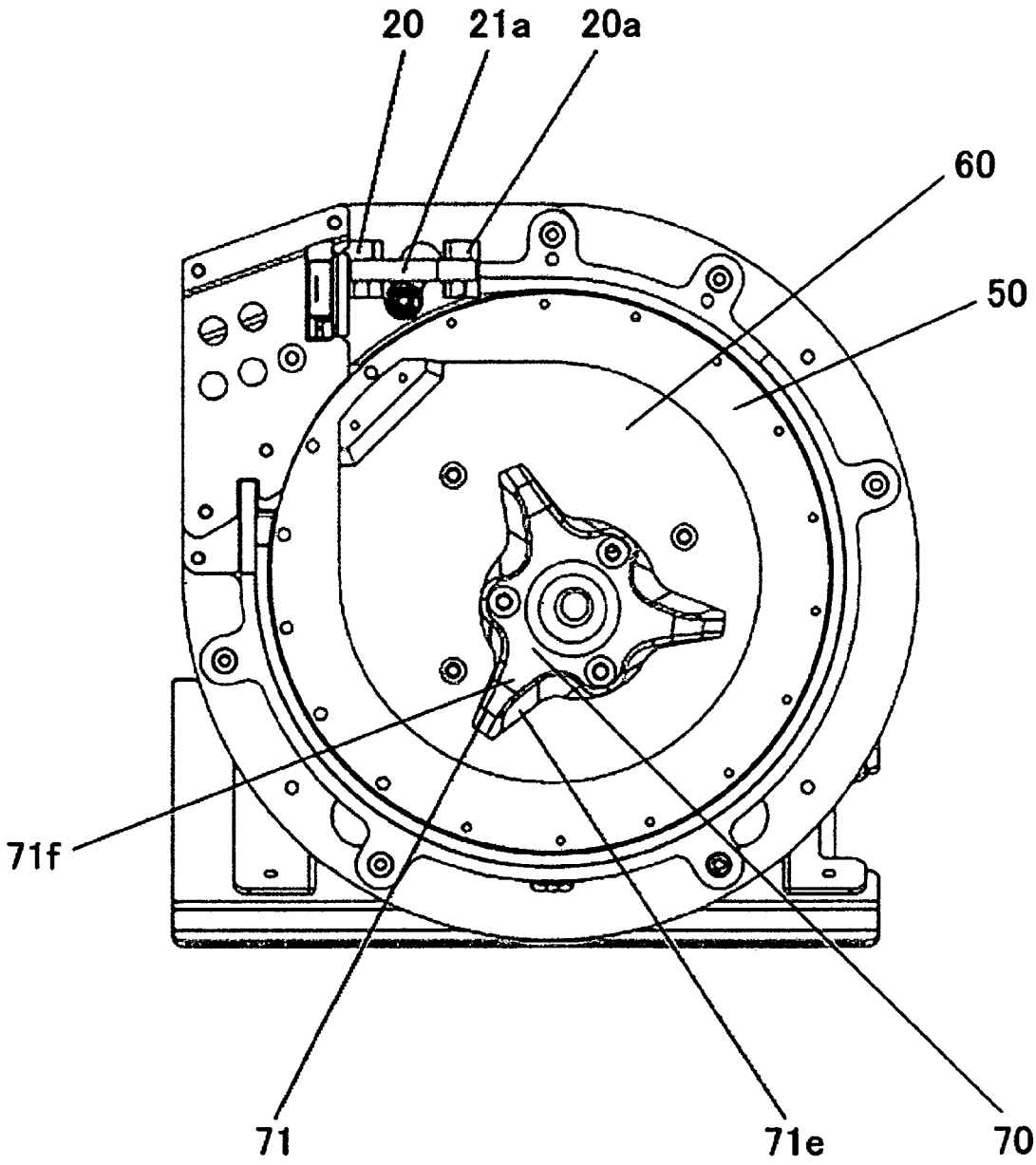
FIG. 16 is a perspective view showing another structure of the agitator and the unallowable coins blocking piece.

By using FIGS. 3 and 7, the unallowable coins blocking piece 21 can be seen attached on the unallowable coins blocking piece attaching section 20. As another unallowable coins blocking piece, as shown in FIGS. 15 and 16, the coin passage has an unallowable coins blocking piece attaching section 20*a*, a dispensing roller attaching section 10, and an allowable coins blocking piece attaching section 20 from the side of the disc 50. By sandwiching the dispensing roller 10, the coin passage has the unallowable coins blocking piece attaching section between the unallowable coins blocking piece attaching section 20 and the unallowable coins blocking piece attaching section 20*a*. The unallowable coins blocking piece 21*a* is provided on both unallowable coins blocking piece attaching section 20 and 20*a*.

The unallowable coins blocking piece 21 has a long elongated plate-like configuration, and the end section on the side of the disc 50 is formed in an inclined configuration. Furthermore, the end section thereof is formed in a bridge-like configuration to prevent the piece 21*a* from contacting the dispensing roller 11 with the result that the end section is projected toward the upper side from the coin passage with a pillar not shown which is integrally formed on both sides of the piece 21*a*.

With the unallowable coins blocking piece 20, the unallowable coins which are energized after being dispensed with the dispensing roller 11 is brought back to the hopper head portion 2*a*. Furthermore, in the unallowable coins blocking piece 21*a*, it is constituted in such a manner that the unallowable coins which come from the disc 50 prior to dispensing the coins with the dispensing roller 11 are brought back to the hopper head portion 2*a* from the end section having an inclined surface configuration of the unallowable coins blocking piece 21*a*. In examples shown in FIGS. 3 and 7, it is possible that the coins may be joggled between the chute 40 and the blocking piece 21 with the energizing of the coins. In examples shown in FIGS. 15 and 16, the unallowable coins are not energized so that the coins are allowed to fall in the coin bowl 2 with certitude.

Consequently, the unallowable coins blocking piece 21*a* may be used instead of the unallowable coins blocking piece 20.

In the aforementioned coin sensor 31, for example, a U-shaped electro-magnetic sensor is used, and the coin sensor 31*a* is arranged in such a manner that the U-shaped section embedded with the detection section 31*a* for detecting the coins to be detected is located on both sides of the passage Pb. The coin sensor 31 moves the notch section 43 in a direction perpendicular to the coin dispensing passage Pb while the width direction of the chute 40 is provided on the chute 40 in a manner of spanning the coin transport passage Pb along the inner surface 41 of the chute 40 and the upper surface of the main body 3 of the hopper.

That is, the detection section 31*a* of the coin sensor 31 is located on the chute 40 so that the section 31*a* is not projected into the coin transport passage Pb from the upper surface of the inner surface 41 of the chute and the base section 3*d*. That is, the coins do not collide with the detection section 31*a*.

Incidentally, in the coin sensor 31, not only an inverted U-shaped electromagnetic sensor but also an inverted U-shaped optical sensor can be also used. a non-U-shaped electro-magnetic sensor can be also used. Furthermore, in the case of the non-U-shaped electro-magnetic sensor, the detection section is recessed from any surface on the side of the inner surface 41 of the chute or the side of the base section 3*d* to be located on the chute 40. In other words, such arrangement is provided for preventing the coins from colliding with the detection section.

In FIG. 3, about three fourth of the outer circumference of the fixed guide 60 is concentric with the rotary disc 50 and has a smaller diameter. One fourth of the outer circumference is extended in a direction of a tangent line. as a whole, the fixed guide has a tear-drop configuration. The fixed guide is formed of a plate-like body having at least two thirds of the thickness of a predetermined coin, for example relatively hard and rigid metal such as steel plate material or the like. The fixed guide is fixed to the base section 3*d* which is projected for the portion of the thickness with respect to the upper surface of the rotary disc 50.

A thickness of the fixed guide 60 is generally the same as the thickness of the coins. That is because two coins may be stacked and would not be guided in the dispensing guide 63*a* and 63*b*.

Furthermore, the fixed guide 60 is located on the rotary disc 50. The side surface of the outer circumference and the surface of the rotary disc 50 form a coin transport passage Pm.

That is, in the fixed guide 60, the thickness surface which forms an outer circumference side surface has a right angle surface with respect to the surface of the rotary disc 50. Then, the right angle and the surface of the rotary disc 50 form a coin transport passage Pm for guiding and moving the coins in a direction of the coin transport.

On the fixed guide 60, a round coin transport guide 63*a* and on the outer circumference of a round coin transport guide 63*a*, a horizontal coin transport guide 63*b* are formed which extend in a direction of the tangent line.

Furthermore, the horizontal coin transport guide 63*b* is detachably fixed to a different piece 61 on the side surface of the end section of the horizontal coin transport guide 63*b* in order to make the thickness thereof thicker than other round coin transport guide 63*a* with a view to correspond to coins having different thicknesses. Therefore, the thickness of the guide 63*b* exceeds the thickness of the coin. Furthermore, the guide surface of a different piece 61 is inclined to form an acute angle with respect to the upper surface of the rotary disc. In the case where the coins are pressed against the guide surface of a different piece 61 with the dispensing roller 11 because of this inclination, the coins are pressed against the upper surface of the rotary disc with the coin divisional force to be pressed outward while preventing the coins from falling from the guide 63*b*. Incidentally, this different piece 61 and the transport guide section itself may be integrally formed to a thick thickness.

Furthermore, the different piece 61 forms a trapezoid configuration as seen from a plane surface, so that a hole 61*c* for screws for the attachment and fixture on the fixed guide 60 and the positioning pin not shown for positioning on the fixed guide 60 are embedded on the rear surface thereof.

Incidentally, the different piece 61 is formed of steel material in the same manner as the rotary disc 50. In particular, the steel is preferable which is quenched to endure abrasion with the passage of time resulting from the contact with a metal-made coins.

Figure 8:
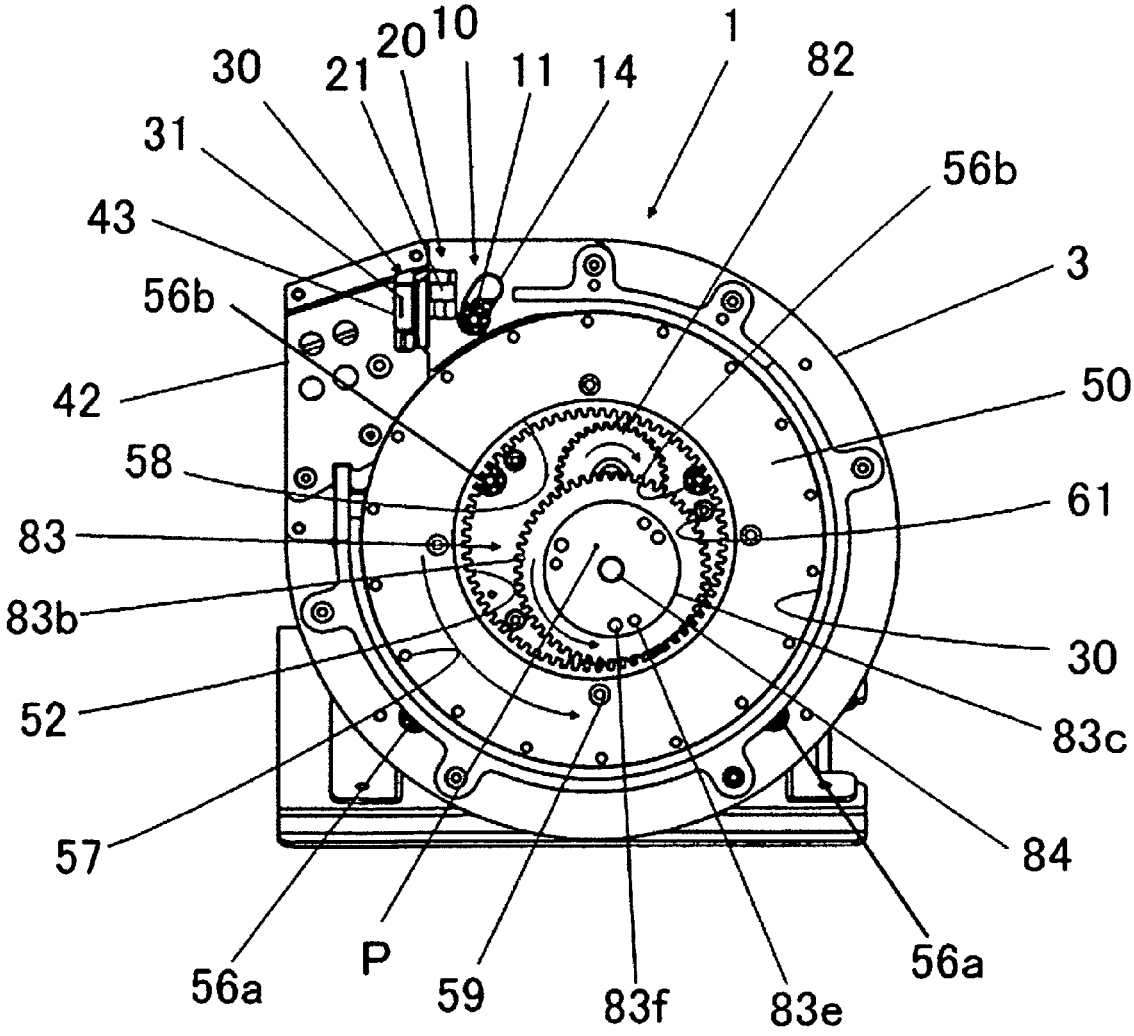
FIG. 8 is an explanatory view showing a wheel structure according to Embodiment 1 of the present invention.
Figure 10:
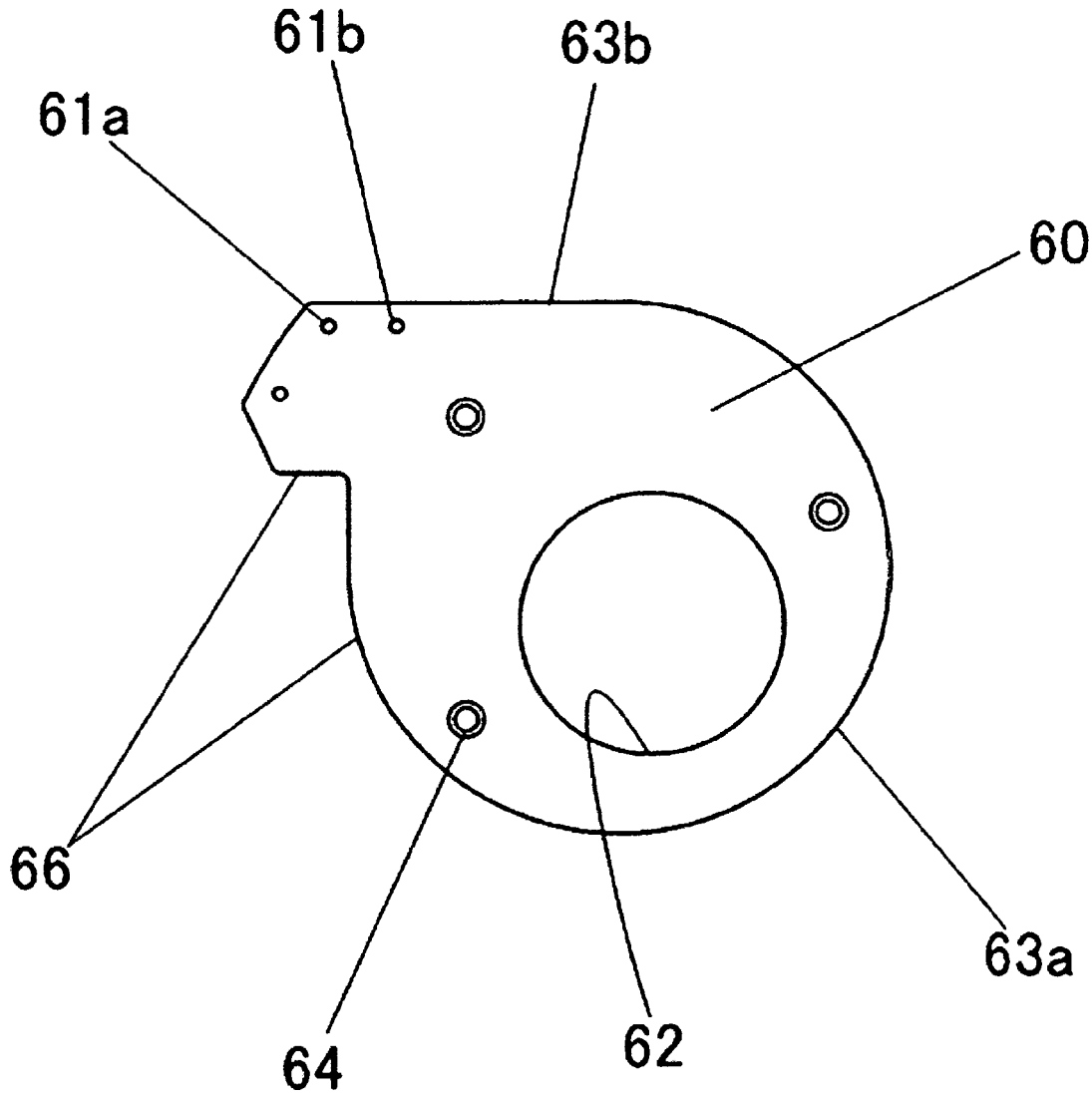
FIG. 10 is a plan view showing a fixed guide.

Furthermore, as shown in FIGS. 7 and 8 as well as in FIG. 10, a round hole 62 which enables the positioning of the projected surface 83*c* of the second transmission gear 83*b*, an attachment hole 61*b* for attaching and fixing the different piece 61 and a positioning hole 61*a* which allows the penetration of the positioning pin therethrough are penetrated on the fixed guide 60. Furthermore, an attachment hole 64 for attaching and fixing the different piece 61 to the base section 3*d* via the spacer 65 is also provided.

Since a round hole 58 of the fixed guide 60 is fit with a projection 83*c* of the second transmission gear 83*b*, the center thereof is slightly moved to the downward direction with respect to the central position P shown in FIG. 7 which forms the same axis with the rotary disc 50 while the hole is formed with a slight movement in a counterclockwise direction of the rotary disc 50.

Incidentally, this fixed guide 60 is attached and fixed to the main body 3 of the hopper with a slight space with respect to the rotary disc 50 to prevent the contact with the spacer 65.

In the case where the fixed guide 60 is located at a position higher than the center P of the coin located between the coin anchor pins 57 of the rotary disc 50, the fixed guide 60 is supported with the transport guide 63*a* and the upper surface of the rotary disc 50, and is pressed with the anchor pin 57 and rotates around the round transport guide 63*a* to be transported to the downstream direction through the coin transport passage Pm.

Furthermore, the coins are moved to the horizontal transport guide 63*b* which extends in a direction approximately in parallel with the tangent line direction of the fixed guide 60 and to The horizontal transport guide 63*b* which is attached with a different piece 61 located opposite to the dispensing roller 11 in the state in which the coins are arranged in a row one by one while being pressed with the coin anchor pin 57.

At this time, the coins are pressed to the side of the transport guide 63*b* with the dispensing roller 11. However, even in the case where the coins are pressed with the dispensing roller 11 with the different piece 61 owing to the thickness of the guide 63*b*, the friction is increased between the coins and the guide so that the coins do not fall. Even in the case of the configuration having a different thickness, or even in the case of a configuration in which the both side angles in the thickness direction is dangled, the coins are held on a horizontal transport guide 63*b* with the different piece 61.

Furthermore, the coins are moved against the energizing force of the dispensing roller 11 with the pressing force of the coin anchor pin 57. Immediately after the contact position of the dispensing roller 11 passes through the diameter section of the coins, the coins are dispensed out into the passage Pb with the return force of the dispensing roller 11.

At this time, the coins having an outer diameter which does not allow the passage through the coin transport passage Pb of the chute 40 collide with the inclined surface of the unallowable coins blocking piece 21 provided between the dispensing roller 11 and the chute 40 with the result that the upper end thereof is flipped in an upward direction and the coins are deviated from the passage Pb and driven out to fall into the hopper bowl 2.

Otherwise, the unallowable coins which comes from the disc 50 before dispensing the coins with the dispensing roller 11 are allowed to fall in such a manner that the unallowable coins are brought back into the hopper bowl 2 with the end section which section has an inclined surface of the unallowable coins blocking piece 21*a*.

Furthermore, either of these unallowable coins blocking pieces 21 and 21*a* moves up and down with respect to the coin transport passage Pb in association with the coin sensor 31 with the result that the piece 21 or 21*a* can be adjusted in an upward and a downward direction in advance in accordance with the outer diameter of the coins.

The coins which are dispensed with the dispensing roller 11 and have passed under the unallowable coins blocking pieces 21 and 21*a* move into the chute 40.

The coins which move into the chute 40 are detected with the coin sensor 31 which is provided spanning the vertical direction with respect to the coin transport passage Pb of the chute 40 in an appropriate distance with the dispensing roller 11. The coins are counted and the detection signals are counted with a counter not shown, and the counted number becomes the coin transport number. Then the coins are transported via the coin delivery outlet 42 of the chute 40.

The coins which are dispensed into this chute 40 are detected with the coin sensor 31 after being completely dispensed with the dispensing roller 11 because the dispensing roller 11 and the coin sensor 31 in the chute 40 are separated at an appropriate distance.

Furthermore, the coin sensor 31 is provided on the unallowable coins blocking piece attaching sections 20 or 20 and 20*a* along with moves up and down in the notch section 43 in such a manner that the detection section 31*a* runs across the coin transport passage Pb at a right angle along with the up and down movement of the unallowable coins blocking pieces 21 and 21*a* while the detection section 31*a* is not projected to the inside of the coin dispensing passage Pb from the inner surface 41 of the chute, and the upper surface of the base section 3*d*. as a consequence, even when the coins which are dispensed into the chute 40 are stacked and detained in the coin dispensing passage Pb of the chute 40 and the joggling of the coins are generated, the breakage of the coin sensor 31 resulting from the inner pressure of the coin joggling can be prevented.

The inner pressure resulting from the joggling of the coins which are detained in the coin transport passage Pb of the chute 40 is applied to the inner surface 41 of the chute and the upper surface of the main body 3 of the hopper with the result that the chute 40 and the main body 3 of the hopper protect the coin sensor 31.

In the case where the number of the coin transport from which the detection signal of the coin sensor 31 is counted reaches a predetermined number, a coin transport termination signal is output, the geared motor 80 is suspended and the coin hopper 1 is suspended.

Figure 4:
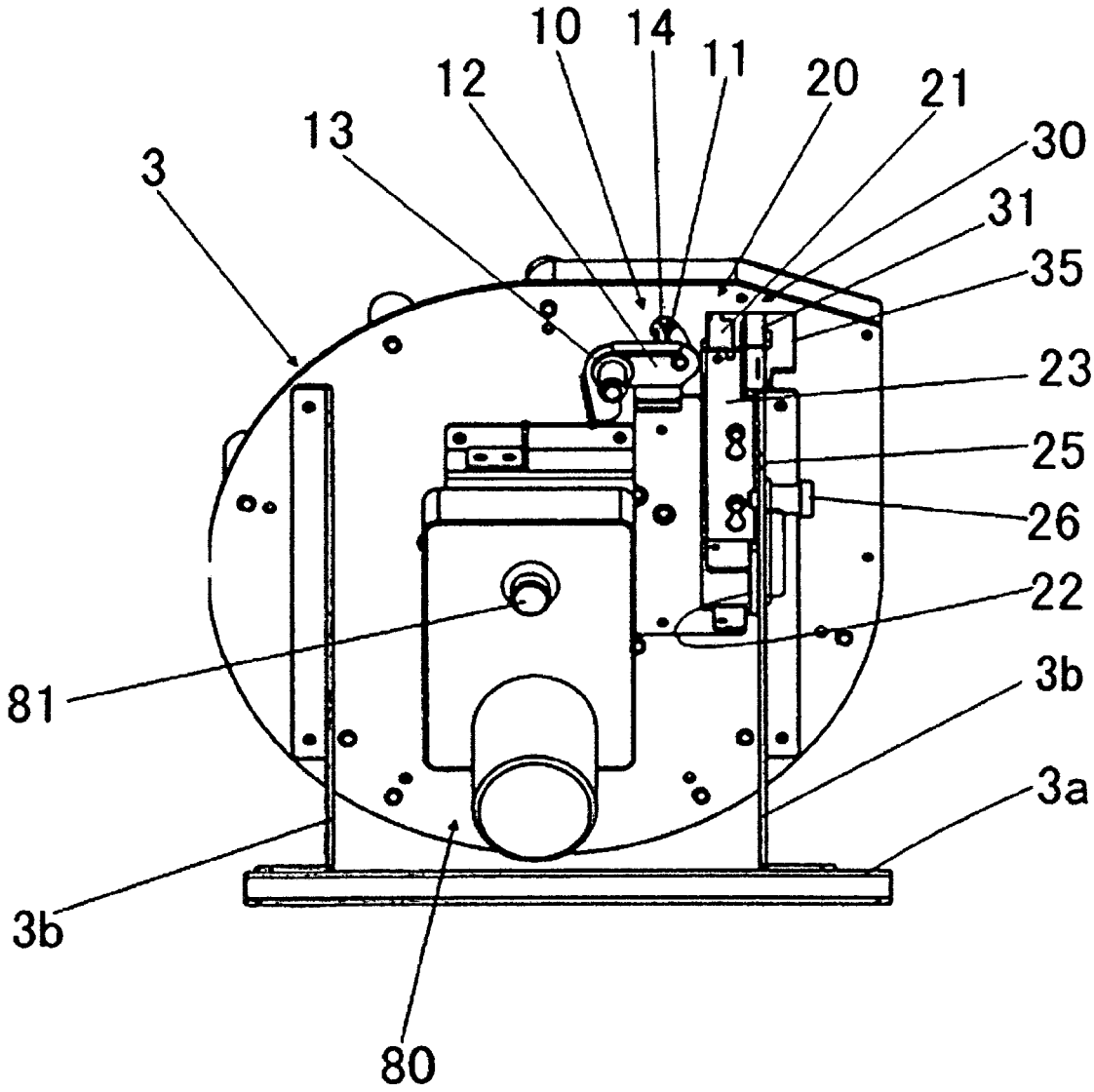
FIG. 4 is a rear view of FIG. 3.
Figure 5:
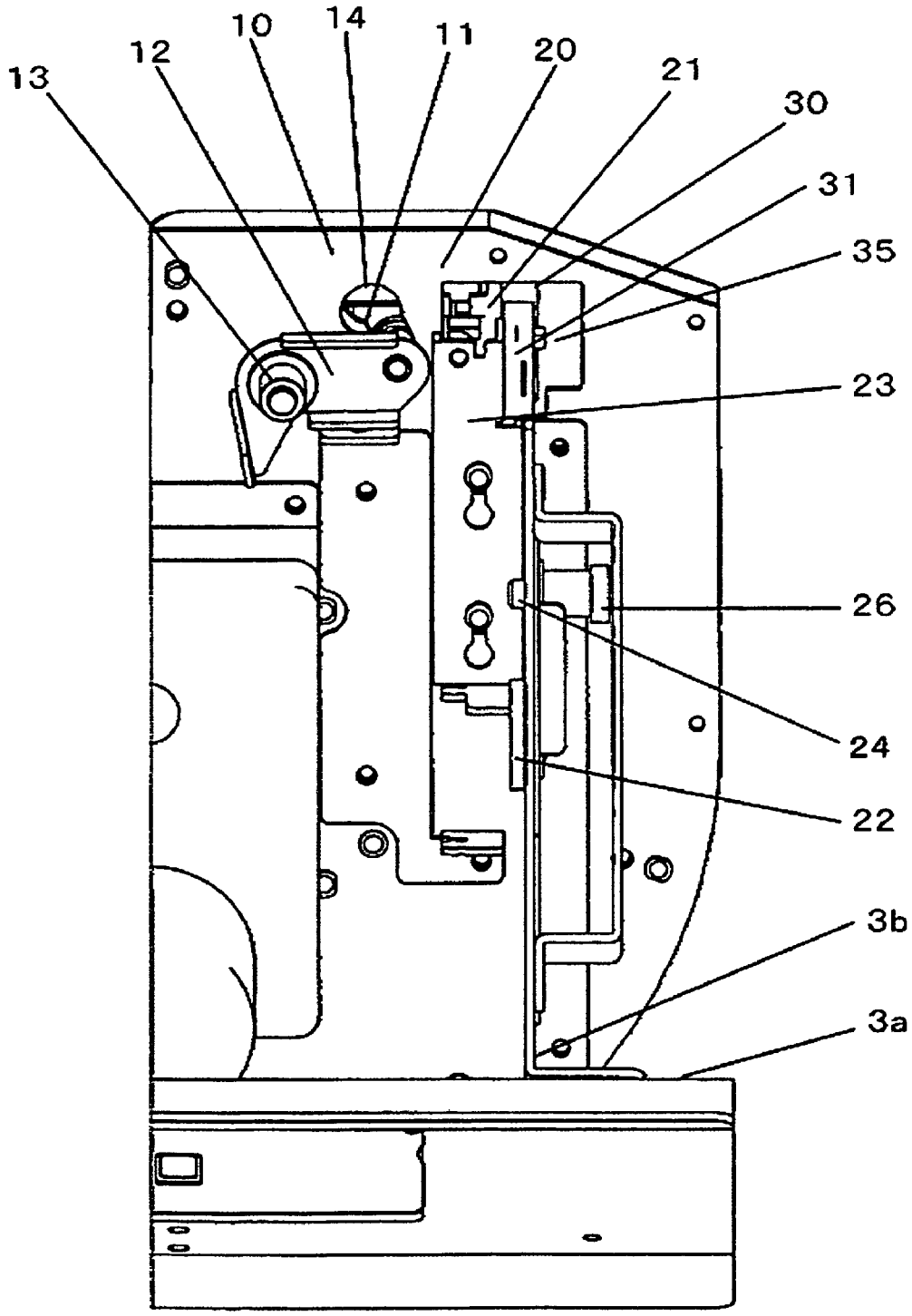
FIG. 5 is a partially enlarged view of FIG. 4.

As shown in FIG. 4 and in FIG. 5 which is a partially expanded view of FIG. 4, a motor, for example, the geared motor 80, the dispensing roller attaching section 10, and the unallowable coins blocking piece attaching section 20, and the coin sensor attaching section 30 are arranged on the rear surface of the base section 3*d*.

The dispensing roller attaching section 10 comprises a dispensing roller 11, a rotation arm 12 which is rotatably and axially attached with the dispensing roller 11, a spring shaft 13 for constantly applying a downward elastic force to the rotation arm 12 with spring means not shown, and a long hole 14 for an elastic roller through which the dispensing roller 11 moves, wherein the dispensing roller 11 is exposed to the side of the coin transport passage Pm from the long hole 14 for elastic roller which is formed on the main body 3 of the hopper.

Figure 6:
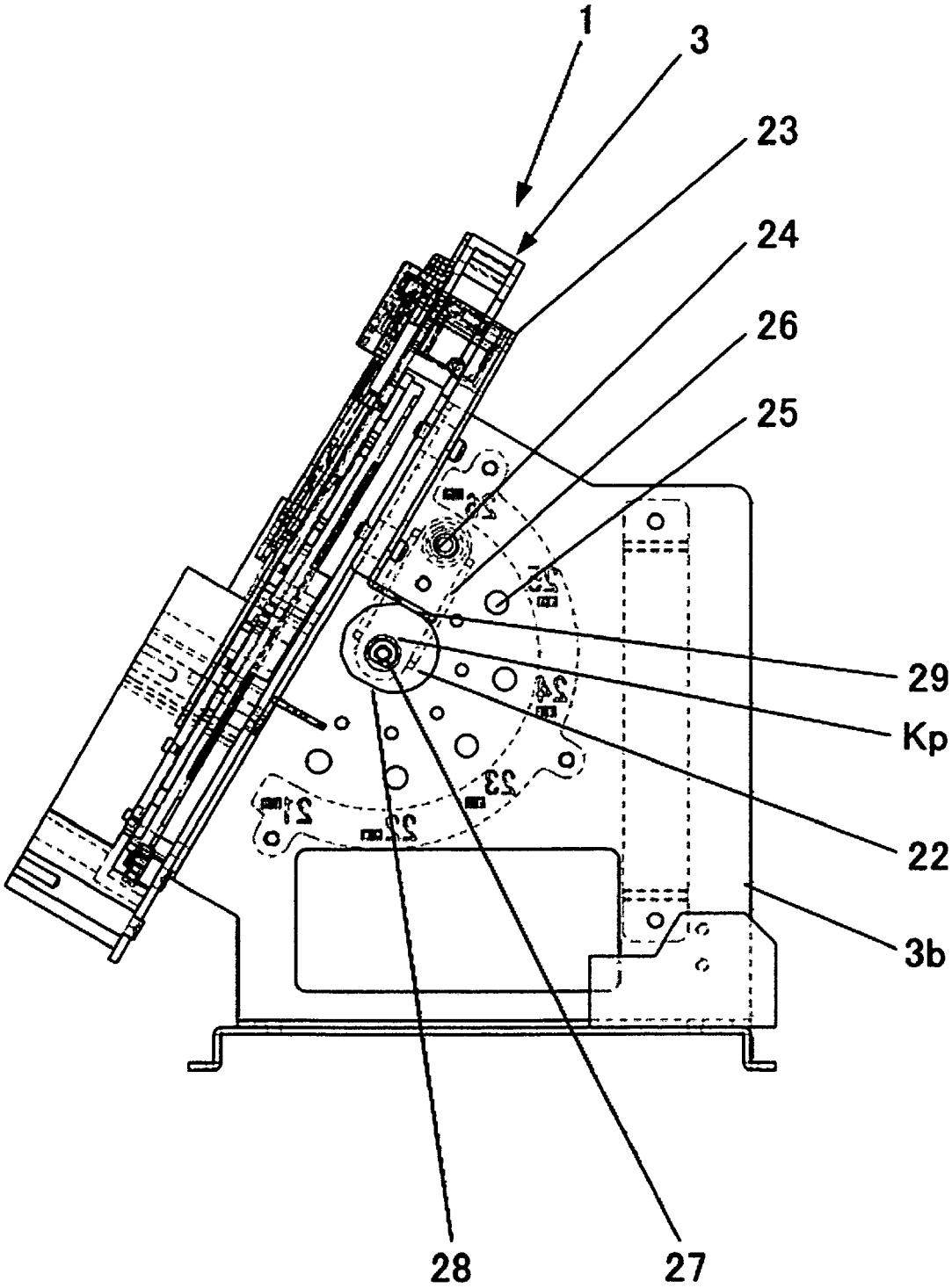
FIG. 6 is a left side view of FIG. 4.

As shown in FIG. 5, 6 or 15, the unallowable coins blocking piece attaching section 20 comprises a slider 23 for moving up and down the unallowable coins blocking piece 21 or the unallowable coins blocking piece 21*a* which is provided on the unallowable coins blocking piece attaching sections 20 and 20*a*, a cam 22 located on the lower section of the slider 23 for moving up and down the slider 23 with the rotation thereof, and a handle 26 rotatably fixed to the cam 22 for adjusting the rotation position of the cam 22 by rotatably attaching the cam 22, and selecting and rotating the plurality of notch holes 25 which are penetrated into the support side wall section 3*b*.

A plurality of notch holes 25 are provided on the support side wall section 3*b* along the diameter from the center of the rotation of the cam 22.

Incidentally, the cam 22 is provided with a cam shaft 27 by changing the center thereof from the center of the disc of the cam 22. as a consequence, the cam changes the center thereof and is rotated by rotating the handle 26 fixed to the cam shaft 27 with the result that the cam is bent in an angle-like configuration at the lowest position of the slider 23 contacting the cam 22 and the cam 22 can move up and down the lower plate 29 of the slider which extends in a direction of the cam 22. as a consequence, the slider 23 which is integrally formed with the lower plate 29 of the slider can be moved up and down. The lower plate 29 of the slider comes into contact with the cam 22 with the result that the projection section 24 of the handle 26 is inserted into the notch hole 25 to fix the cam 22. That is, the slider 23 is positioned and fixed. On the outer circumference of the cam, a plurality of sections corresponding to the notch hole 25 to which the cam 22 is fixed have a cam plane surface section 28 which is obtained by processing the outer circumference of the disc-like cam 22 in a plane-like configuration, so that the lower surface 29 of the slider closely contacts the cam 22.

In order to adjust in an upward and a downward direction the unallowable coins blocking piece 21 or the unallowable coins blocking piece 21*a*, the handle 26 is rotated in order to move up and down the slider 23 to select an appropriate notch hole 25 and to insert the projection section 24 at the end of the handle 26 into the notch hole 25 thereby deciding the adjustment position. as a consequence, since the cam 22 is suspended at a predetermined angle, the slider 23 is positioned at a position corresponding to the radius of the cam in this phase. In other words, the piece 21 or the piece 21*a* or the coin sensor 31 is held at the selection notch hole 25.

As shown in FIG. 7, in the perspective view of the central vertical cross section of the coin hopper 1, there is shown an output shaft 81 of the gear motor 80 positioned at the above right position of the coin hopper, a rotor 51 for rotating the rotation disc 50 and a transmission inner tooth gear 52 which is integrally formed on the center of the rotor 51.

In the aforementioned coin hopper 1, the geared motor 80, which is started by receiving a predetermined number of the coin transport signal, rotates the rotary disc 50 and the agitator 70.

The power transmission or the like of the agitator 70 comprises a drive gear 82 axially attached on the output shaft 81 arranged on the main body 3 of the hopper, a transmission gear 83 having a second transmission gear 83*b* which is integrally formed with the first transmission gear 83*a* engaging with the drive gear 82, an axis 84 and a transmission gear 83 rotatably supporting the transmission gear 83 and located below the center P of the rotation of the rotary disc 50, and provided with a drive gear 82 on the downstream side in the rotation direction. The agitator 70 is formed on the second transmission gear. It is constituted in such a manner that the second transmission gear 83*b* is engaged with the transmission inner tooth gear 52 to rotate the rotary disc 50 fixed to the rotor 51.

That is, the output shaft 81 is rotated in a clockwise direction with the geared motor 80 while the first transmission gear 83*a* is rotated in a counterclockwise direction. The second transmission gear 83*b* which is rotated in a counterclockwise direction is engaged with the transmission inner tooth gear 52, to rotate the rotor 51 in a counterclockwise direction and to rotate the rotary disc 50 attached and fixed to the rotor 51 in a counterclockwise direction.

That is, the output shaft 81 is rotated in a clockwise direction with the geared motor 80 while the first transmission gear 83*a* is rotated in a counterclockwise direction. The second transmission gear 83*b* which is rotated in a counterclockwise direction is engaged with the transmission inner tooth gear 52, to rotate the rotor 51 in a counterclockwise direction and to rotate the rotary disc 50 attached and fixed to the rotor 51 in the counterclockwise direction.

It is constituted in such a manner that the second transmission gear 83*b* which is rotated in a counterclockwise direction with the first transmission gear 83*a* rotates the agitator 70 in a counterclockwise direction centering on the axis 84.

In this manner, the agitator 70 is rotated via the first and the second transmission gear 83*a* and 83*b*. Furthermore, the rotary disc 50 is rotated through the transmission inner gear 52 so that the agitator 70 is rotated in a counterclockwise direction to each other.

Consequently, the rotary disc 50 is rotated by receiving a power transmission from the gear 83 through the transmission gear 52, so that the rotation number of the rotary disc 50 is different from that of the rotator. The rotation ratio of the rotary disc 50 and the agitator 70 is preferably set to a scope of 5:6.

Consequently, even when the rotary disc 50 and the agitator 70 are rotated in a counterclockwise direction to each other, the agitation performance given to the coins becomes different.

Consequently, the agitator 70 moves the axis 84 which forms the rotation shaft in a downward direction with respect to the coaxial center P of the rotary disc and the fixed disc 60 and forms a position which is moved toward the counterclockwise direction of the rotary disc 50.

The movement position of this agitator 70 approximately agrees with the position where the movement of the coins becomes slow, namely the position of 6 to 5 o'clock, and 4 o'clock on the dial of the clock as seen from the front surface of the main body 3 of the hopper as the coins are moved to the rotation direction of rotary disc 50 while the coins are agitated with the agitator 70.

At positions where a relatively large number of coins are collected, the movement of the coins becomes slow. That is because the coins are moved in the same direction with the rotation of the rotary disc 50. However, since the coins are dispensed one by one with the anchor, the coin which is not dispensed is detained. at this location, many coins can be agitated by positioning the agitator 70 to agitate many coins.

Besides, the rotary disc 50 has a rotation number different from the agitator 70. as compared with the agitator 70, the number of rotation is small, and the rotation speed is slow with the result that the agitator 70 agitates the coins and actively changes the posture of the coins by rotating in the same direction the agitator 70 having a large number of rotation and a high rotation speed on this rotary disc 50. Consequently, the coins can be easily hooked with the anchor and is hooked with the anchor without failure.

The agitator 70 has six arms 71 formed in a radial direction in a radial configuration and the agitator 70 assumes a star-like configuration. Consequently, the agitator generates a high synergic effect in the agitation, the movement and the scattering of the coins thereby improving the agitation efficiency. Furthermore, the arm 71 reduces a collision friction with a sharp end section 71*a* forming an acute angle toward the end and a coin escape surface 71*b* which is formed by forming an angle of depression on the side surface in the direction of rotation thereby alleviating a load applied on the agitator 70.

The agitator 70 has an appropriate thickness formed of synthetic resin excellent in anti-friction properties, for example, urethane rubber on the upper surface of the fixed guide 60.

Furthermore, on the central section of the agitator 70, an upper surface side has a cone-like configuration bulged in a cone-like configuration so as to be projected toward the side of the hopper bowl 2 and a lower surface side has a penetration hole 72 which is formed with a play on the head section of the axis 84.

On this agitator 70, an attachment hole 83*f* is penetrated in order to fix the agitator 70 on the circumference of the base section of the arm 71 with a screw of the second transmission gear 83*b*.

With respect to the agitator 70 which has six arms 71 formed in a radial direction in a radial configuration and which has a star-like configuration, as shown in FIGS. 15 and 16, the number of the arms 71 of the agitator 70 can be three. The sharp end section 71*f* which forms an acute angle toward the end, and the coin escape surface 71*e* which is formed by forming the side surface of the rotation direction at an angle of depression have a smooth arc-like inclined configuration than the sharp end portion 71*a* of the agitator 70 having six arms 71. Furthermore, the coin escape surface 71*e* has a larger escape angle than the coin escape surface 71*b*. In other words, an inclined angle for the coin escape is enlarged to a somewhat larger level.

In the case of the agitator 70 having six arms 71, the agitation properties are excellent whereas it sometimes happen that the coins penetrate into the escape surface 71*b* of the arm 71. However, the sharp end section 71*f* is formed is a smooth arc-like configuration, an escape angle of the coin escape surface 71*e* is made somewhat larger with the result that the coins can be smoothly guided to the side of the upper surface of the agitator 70 thereby inhibiting the penetration into the escape surface 71*e* of the arm 71.

Incidentally, the agitator 70 is formed in a star-like or an approximately triangular configuration. However, the configuration is not necessarily limited thereto. It goes without saying that the arm thereof can be a single arm which extends in a radial direction centering on the axis 84. Furthermore, the agitator 70 can be rotated in a direction reverse to the rotary disc 50.

Furthermore, in the drawings, with respect to the rotary 51, a projecting inner circumferential end 51*a* is formed which is projected in a concentric configuration so as to be fit the rotary disc 50 to surface agreement on the upper surface thereof while the rotary 51 has a circular hollow section 58 having a transmission tooth gear 52 formed on the projecting inner circumference 51*a*. The rotary 51 has a donut-like thin disc-like configuration formed of, for example, polyacetal, and acetal resin.

Furthermore, on the rotary 51, there is formed a ring-like groove 54 is through which a ring-like thrust bearing not shown is formed on the lower surface thereof. The rotary 51 is rotatably supported between the ring-like jaw section 3*g* and a base section 3*d* of the main body of the hopper shown in FIG. 3. Into the thrust bearing, a plurality of cone-like rollers are fit, for example into a ring-like support belt in an appropriate distance.

Furthermore, the attachment hole 55 is penetrated through the upper surface of the rotary 51 for integrally attaching and fixing the rotary disc 50.

Furthermore, as shown in FIG. 8, there are provided on the rotary 51, outer guide rollers 56*a* and 56*a* which contact the outer circumference side surface of the rotary 51 at a position lower than the central shaft and which rotates on the fringe of the two outer circumference surfaces in line symmetry with the respect to the vertical line which runs through the center of the rotary 51. Furthermore, there are provided on the inner circumference surface provided on the lower part of the transmission tooth gear 52 a total of three inner side surface guide rollers 56*b*, 56*b*, and 56*b* which rotate on the fringe of the inner circumference; two of the inner guide rollers contacting the inner circumferential side surface of the rotary 51 at an upward direction position than the central shaft and being located in line symmetry with respect to a vertical line passing through the center of the rotor 51; one roller being located on a vertical line passing through the center of the rotor 51 as shown in FIG. 7 and at a position immediately under the transmission inner tooth gear 52.

The rotary disc 50 has an outer diameter which is penetrated with a play into an inner diameter of the ring-like jaw section 3*g* of the main body 3 of the hopper while the rotary disc 50 forms a donut-like thin disc-like configuration having a round hole 58 having an inner diameter which is fit into the projecting inner circumferential fringe 51*a* of the rotary 51, the disc being formed of steel material.

Furthermore, a plurality of coin anchor pin 57 arranged in a predetermined distance are embedded on the upper surface of the rotary disc 50, and an attachment hole 59 for integrally fixing to the rotary 51 is penetrated therethrough.

A projecting surface 83*c* is formed which allows the fitting of the fixed guide 60 of the upper surface section of the second transmission gear 83*b* of the transmission gear 83 while a through-hole 83*d* for allowing the penetration into the axis 84, a hole 83*e* for positioning the agitator and suspending the rotation are penetrated. Furthermore, an attaching hole 83*f* for the agitator is provided thereon.

Incidentally, a thrust washer not shown is intervened between the upper surface of the main body 3 of the hopper and the first transmission gear 83*a* of the transmission gear 83 to prevent the lower surface of the gear from contacting the surface of the main body 3 of the hopper directly with the result that the gear is rotated smoothly on the main body 3 of the hopper centering on the axis 84.

This thrust washer is formed of, for example, resin comprising synthetic polymer compound and graphite particles, the thrust washer is free from plastic deformation, and has a small friction constant.

Here, when the application scope of the coins in the coin hopper according to the present invention is described, the slider 23 attached with and integrated with the coin sensor 31 is moved up and down in correspondence with the each kind of coin as has been described above thereby appropriately adjusting the position of the coin sensor 31 to adjust the position of the coin sensor 31 to the coin diameter.

For example, euro coins will be cited as an example for explanation. The diameter of 10-cent euro is 19.7 mm while the diameter of 2-euro coin is 25.7 mm. In the coin hopper 1 according to the present invention, the coins ranging from the coins having a diameter of euro cent coin to the coins having a diameter of 10 euro cent coins can be transported without exchanging the parts only at the position adjustment corresponding to the coin diameter of the coin sensor 31.

Figure 9:
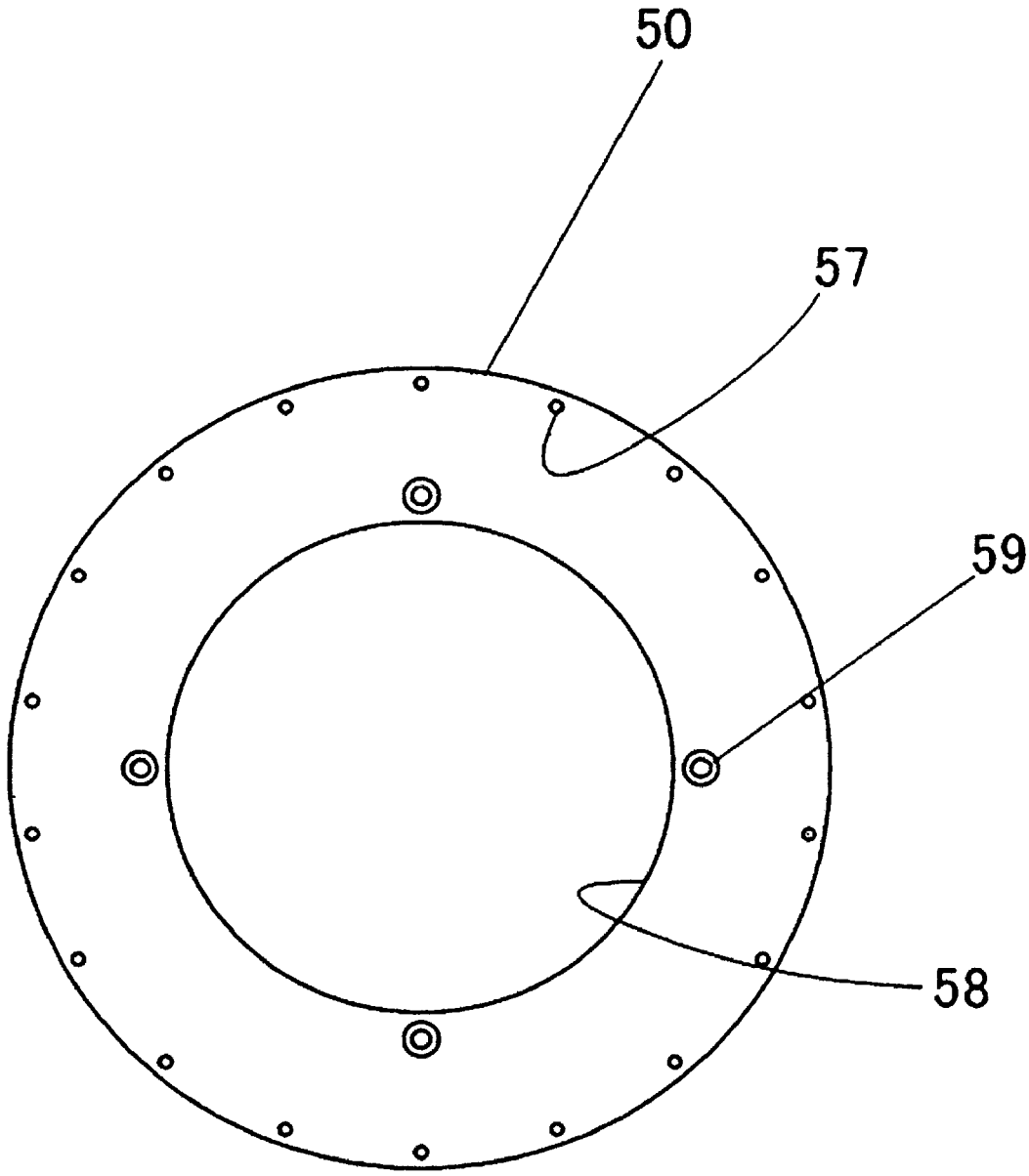
FIG. 9 is a plan view showing a rotary disc.

Furthermore, in order to conform to the coins of 25.7 mm or more, it becomes possible to correspond to the coins having a large diameter from 26 mm to 38 mm by exchanging the rotary disc 50 and the fixed guide 60 shown in FIGS. 9 and 10 so as to correspond to the coin diameter having a large diameter. Specifically, the part 63*a* is further exchanged with a fixed disc having a smaller diameter, and the rotary disc is exchanged with the rotary disc 50 having a larger distance between the anchor 57.

Furthermore, it is possible to correspond to and to handle many kinds of coin transport with one coin hopper by assembling the rotary disc for exchange and the fixed guide for exchange in correspondence with the coin size.

Even when the rotary disc for exchange and the fixed disc for exchange are exchanged with the rotary disc and the fixed disc corresponding to the coin size in this manner, the coins are transported at a stable posture while moving and supporting the coin hopper with the coin anchor pin 57 of the rotary disc and the transport guide of the fixed guide thereby counting and transporting the coins. Unlike the conventional apparatus, it never happens that a transport disparity is supplied owing to an unstable transport of the coins resulting from a shift in the position of the pin and the coins every time the assemblage of the stack wheel and the pinwheel are changed with the result that the coins can be transported in an efficient and stable manner.

Furthermore, as shown in FIG. 10, an escape guide 66 which is formed by notching the lower part of the horizontal coin transport guide 63*b* attached with a different piece 61 is formed on the fixed guide 60. It is preferable to form a place of escape of coins which moves in a reverse direction with respect to the agitator 70 and the rotary disc 50.

Embodiment 2

Next, by referring to FIGS. 11 through 14, Embodiment 2 of the present invention will be explained. The same structure as Embodiment 1 will be denoted by the same reference numeral. Incidentally, the basic structure of the present invention is the same as the structure of Embodiment 1 which has been explained by using FIGS. 1 through 10. Consequently, since an explanation on the basic structure explicated in Embodiment will be overlapped, the explanation on the basic structure will be omitted with respect to Embodiment 2.

Figure 11:
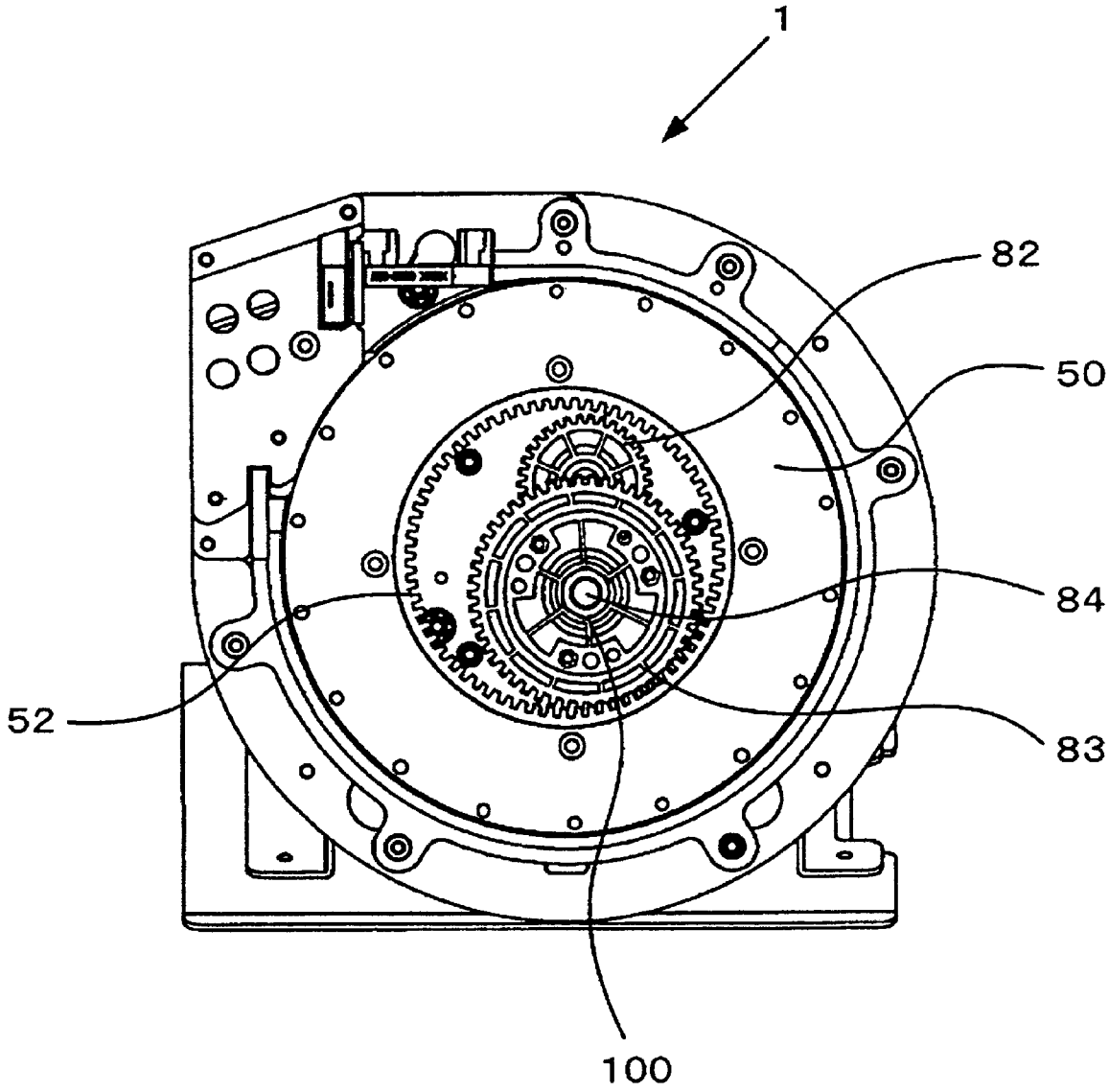
FIG. 11 is a view showing a transmission mechanism according to Embodiment 2.

FIG. 11 is a view showing a transmission mechanism of Embodiment 2 in the coin hopper 1.

Embodiment 2 shown in FIG. 11 comprises a rotary disc 50 for dispensing coins one by one with a plurality of coin anchor pins 57 arranged in a predetermined distance, a transmission inner tooth gear 52, a drive gear 82, a transmission gear 83, and a one way-clutch for preventing a reverse of the axis 84.

Figure 12:
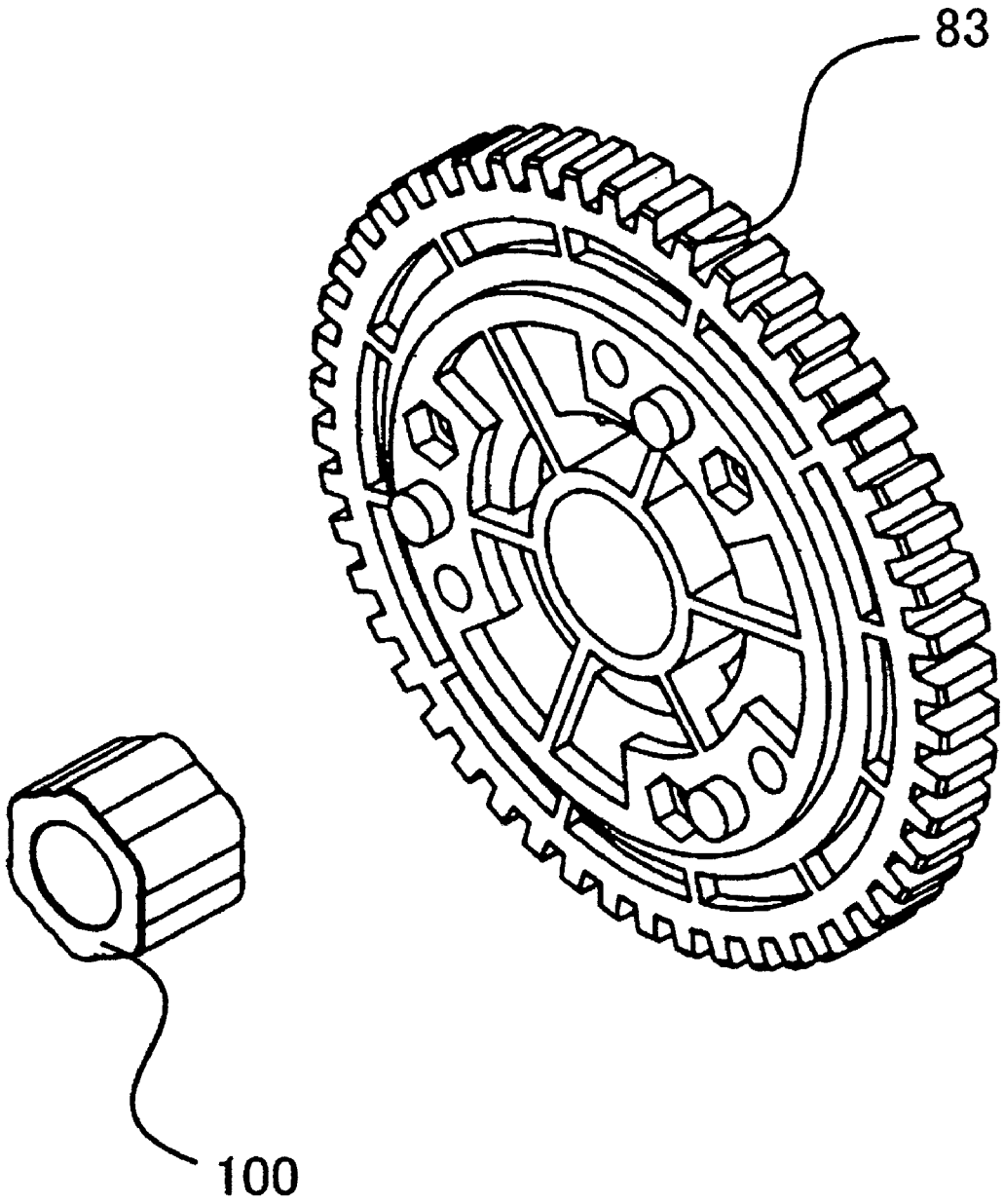
FIG. 12 is an exploded view of a one-way clutch and a transmission gear.

FIG. 12 is a broken view of the one-way clutch 100 detached from the transmission gear 83 prior to pressing and fixing the one-way clutch having a function of preventing the reversion of the transmission gear 83 into an axial hole of the transmission gear 83.

Figure 13:
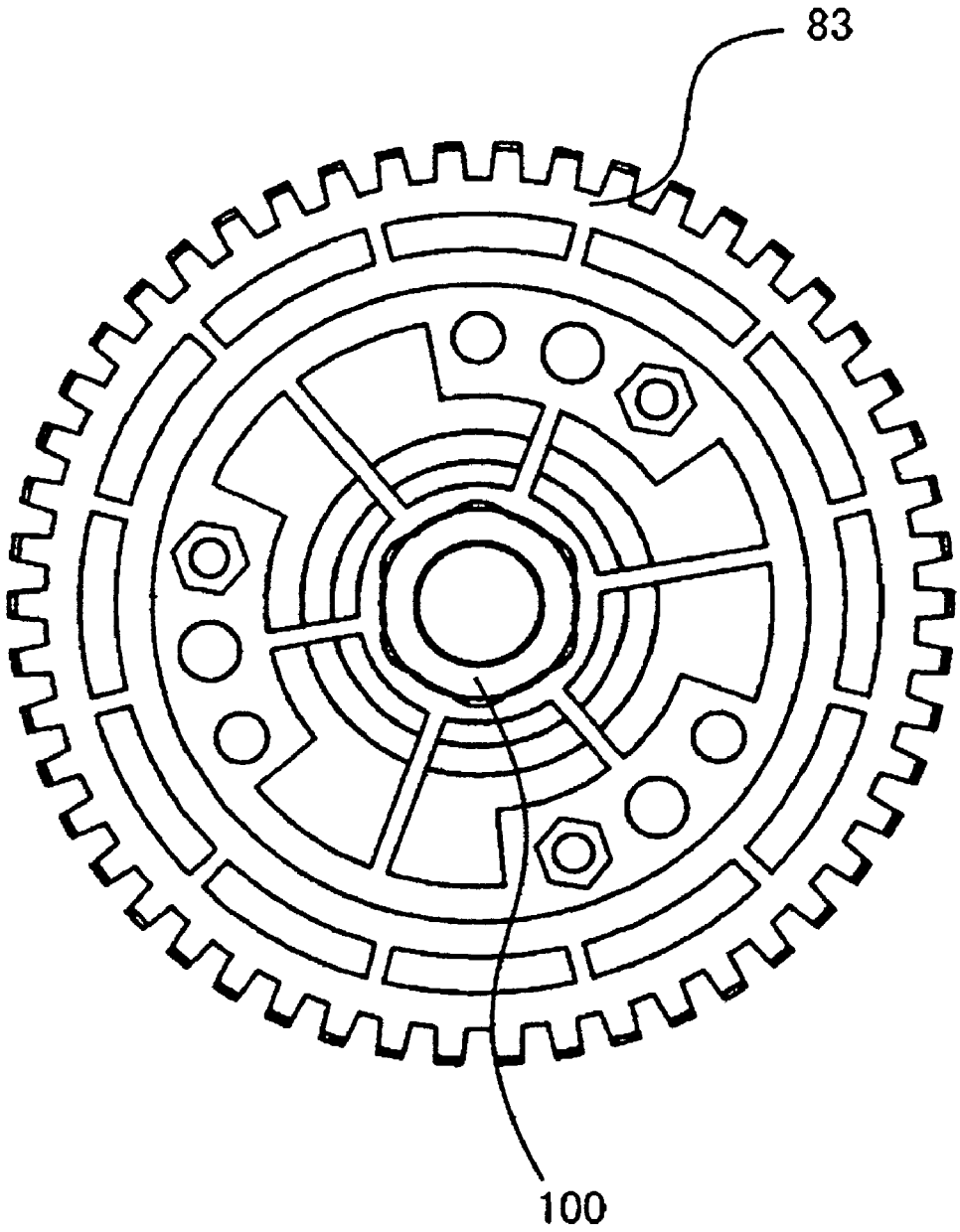
FIG. 13 is a front view showing a state in which the one-way clutch is pressed into the transmission gear.

Furthermore, FIG. 13 is a front view of the transmission gear 83 into which the one-way clutch is pressed which has on an axial hole of the transmission gear 83 a function of preventing the reversion of the transmission gear 83.

It is possible to alleviate the back rush of the rotation disc by pressing and fixing the one-way clutch 100 to a central shaft of the transmission gear 83. Consequently, in the case where the transmission gear 83 does not have a structure without the one-way clutch 100, the back rush of the drive gear and the back rush of the transmission gear 83 are transmitted to the transmission inner tooth gear 52 so that the back rush of the transmission inner tooth gear 52 is increased.

That is, the drive gear 82 is rotated in a clockwise direction with the geared motor 80, and the transmission gear 83 having an integral constitution of the first transmission gear 83*a* and the second transmission gear 83*b* are rotated in a counterclockwise direction. Then, the one-way clutch 100 is also rotated in a counterclockwise direction together with the transmission gear 83. With respect to the transmission gear 83 which allows the intervention of the one-way clutch 100 between the transmission gear 83 and the axis 8, whose reverse rotation is suppressed can be rotated only in the counterclockwise direction. In the case where the drive gear 82 and the transmission gear 83 are suspended, the tooth of each gear comes into contact with the transmission gear 83 only in the direction of the counterclockwise direction in the engagement of the gear tooth of the drive gear 82 and the gear tooth of the second transmission gear 83*b* constituting the transmission gear 83. Consequently, the back rush of the whole gear is eliminated, thereby alleviating the load to respective gears and the friction of the gear.

Next, in FIG. 14, there will be explained a structure for corresponding to any change of a small size from the temperature and the humidity of the rotary 51.

The rotary 51 is formed of thermo-plastic resin (polyacetal). In particular, the polyacetal resin is subject to the effect of environmental changes such as temperatures and/or humidity, and the resin is easily affected by high absorption of moisture and temperature change.

The rotary 51 is formed of the aforementioned polyacetal resin which minutely swells and shrinks under the influence of the change in the temperature and humidity. The value of change is on the order of 100 to 200μ but such value affects a smooth rotation of the rotary 51 and the rotary disc 50.

Figure 14:
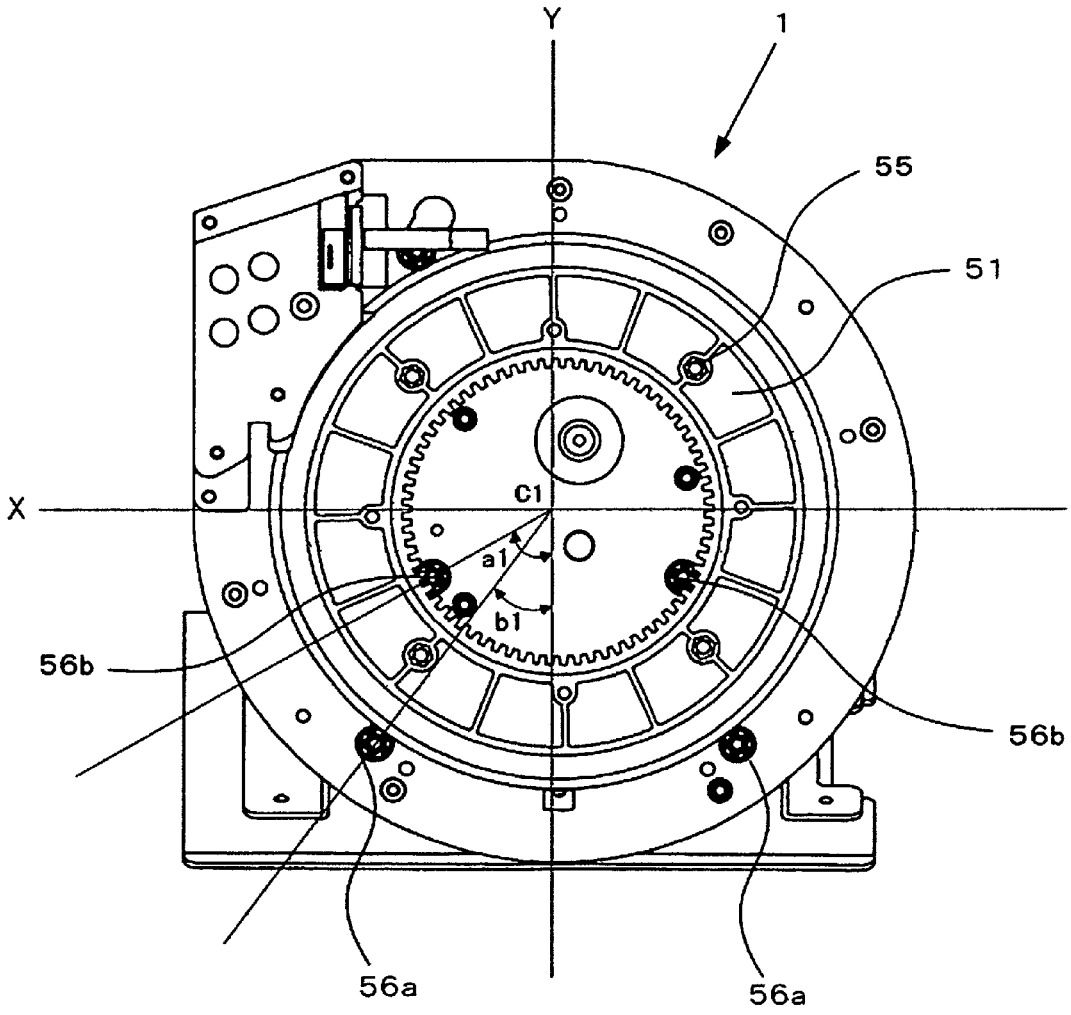
FIG. 14 is a front view showing a rotary and a guide roller according to Embodiment 2.

Consequently, even when the rotary 51 is largely affected by the change in the temperature and/or humidity, as shown in FIG. 14, at an allowable location which is not affected by the rotation and drive with respect to the bulging and shrinking of the rotor 51 there are provided on the rotor 51, outer guide rollers 56*a* and 56*a* which comes into contact with the outer circumference surface of the rotor 51 at a position lower than the central line x and which rotate on two fringes of the outer circumference surface in line symmetry with respect to the central line Y. as an angle b1 as seen from the central point C1 of the rotary 51, 37.5° on one side is preferable. Furthermore, there are provided on the inner circumference side surface of the rotary 51 inside guide rollers 56*b* and 56*b* which come into contact with the inner circumference side surface of the rotary 51 at a position lower than the central line X and which rotates on the fringe of the two inner circumference surfaces in line symmetry with respect to the central line Y of the rotary 51. as an angle a1 as seen from the central point C1 of the rotary 51, an angle of 62° on one side is preferable.

Here, the outer guide rollers 56*a* and 56*a* are shown such that the angle b1 as seen from the central point C1 of the rotary 51 is 37.5° on one side whereas inner guide roller 56*a* and 56*b* are shown such that the angle a1 as seen from the central point C1 of the rotary 51 is 62° on one side. However, the angles can be adjusted to appropriate degrees, and the angles are not necessarily set to the aforementioned set angles.

Therefore, outer guide rollers 56*a* and 56*a* and inside guide rollers 56*b* and 56*b* are provided on the rotary 51, so that the effect of the aforementioned polyacetal resin is alleviated.

That is, the rotary 51 is slightly bulged at high temperatures and humidity. Consequently, two outer guide rollers 56*a* and 56*a* and two inner rollers 56*b* and 56*b* are positioned and attached in order to minimize the effect of the change portion of the height and the inner diameter as a result of the bulging of the rotary 51 with two outer guide rollers 56*a* and 56*a* and two outer guide rollers 56*b* and 56*b*. In other words, the height of the rotary 51 is slightly heightened and raised because of the bulging of the rotary 51 from the position of the outer guide rollers 56*a* and 56*a* which contact the outer side surface of the rotary 51. Furthermore, the inner diameter is slightly enlarged. at the most appropriate attaching position of the outer guide rollers 56*a* and 56*a*, the change portion of the height of the rotary 51 is minimized. at the same time, the effect of the inner guide rollers 56*b* and 56*b* which contacts the inner circumference side surface of the rotary 51 is also minimized.

Furthermore, when the temperature and the humidity are low, the rotary 51 is slightly shrunken. Consequently, two inner guide rollers 56*b* and 56*b* and two outer guide rollers 56*a* and 56*a* are positioned and attached in order to minimize the effect of the height and the inner diameter as a result of the bulging of the rotary 51. In other words, the inner diameter of the rotary 51 is slightly reduced because of the shrinkage of the inner diameter of the rotary 51 from the position of the inner guide rollers 56*b* and 56*b* which contact the inner circumference side surface of the rotary 51. Furthermore, since the height of the rotary 51 is also slightly reduced, the rotary 51 is lowered as a whole. At the most appropriate attaching position of the inner guide rollers 56*b* and 56*b*, the change portion of the inner diameter of the rotary 51 is minimized. at the same time, the effect of the outer guide rollers 56*a* and 56*a* which contact the outer side surfaces of the rotary 51 is also minimized.

Consequently, an unfavorable effect to the rotation drive with respect to the bulging and shrinking of the rotary 51 with a change in temperature and/or humidity is alleviated with the result that a smooth rotation drive is enabled with the rotary 51 being free from the effect with respect to the change in temperature and/or humidity.

Incidentally, in the aforementioned embodiment, the Embodiments 1 and 2 according to the coin hopper of the present invention have been explained. However, the present invention is not limited to the aforementioned embodiment. The present invention can be changed and improved in various manners within the scope of not deviating from the gist thereof.

A rotary disc provided with a plurality of coin anchor pins on a disc rotatably and detachably on a main body of the hopper, a fixed guide attached and fixed to the main body of the hopper via the rotary disc, and an agitator whose center of rotation is moved with respect to the coaxial center of the rotary disc and the fixed guide via the fixed guide with the result that coins which are in bulk stacked in the hopper bowl can be efficiently agitated and moved and the coins can be efficiently transported with the agitation thereof.

The invention claimed is:

1. A coin hopper comprising:

a hopper bowl for storing coins in a bulk state;

a rotary disc having a plurality of coin anchors, for receiving and dispensing the stored coins one by one in the hopper bowl, the rotary disc is mounted in the hopper bowl and rotates about a first axis that is inclined to a vertical plane;

a fixed guide, has a smaller diameter than a rotation path of the coin receiving anchors, the fixed guide is fixed in the hopper bowl adjacent the rotary disc to support coins as the rotary disc rotates, the fixed guide has a horizontal transport guide portion extending at the top of the fixed guide towards a side of the hopper bowl to translate coins to a coin release passage, the transport guide portion has a thickness equal to or less than the thickness of the stored coins, the horizontal transport guide portion is structured by the fixed guide and a different piece which is detachably fixed to a side surface of an end section of the horizontal coin transport guide, the guide surface of the different piece is inclined to form an acute angle with respect to the upper surface of the rotary disc;

an agitator is mounted for rotation about a second axis offset from the first axis and is located adjacent a coin pickup position in the coin hopper, wherein the agitator has a plurality of radially extending spaced apart arms, wherein the arms have pointed tips and adjacent surfaces having an inclined coin contact portion on the side of the arms;

a single motor and a gear transmission unit that drives the rotary disc in one rotational direction and the agitator in the same rotational direction at a different rotational speed;

a position adjustment mechanism;

a coin sensor mounted on the position adjustment mechanism to monitor the coins dispensed, the position adjustment mechanism includes a slider and a cam member that can adjustably move the slider to position the coin sensor to one of a plurality of positions to sense a particular size coin; and an unallowable coins blocking piece operatively connected to the slider.

2. The coin hopper of claim 1 further including a handle connected to the cam and means for adjustably retaining the handle to lock the slider at a desired position.

3. A coin hopper comprising:

a hopper bowl for storing coins in bulk;

a rotary disc having a plurality of coin receiving anchors for receiving and dispensing coins positioned in the hopper bowl, the rotary disk rotates about a first axis that is inclined to a vertical plane;

a fixed guide having a smaller diameter than a rotation path of the coin receiving anchors, the fixed guide is stationarily fixed in the hopper bowl adjacent the rotary disc to support coins as the rotary disc rotates, the fixed guide has a horizontal transport guide portion extending at the top of the fixed guide towards a side of the hopper bowl to translate coins to a coin release passage, the transport guide portion has a thickness equal to or less than the thickness of the stored coins;

an agitator rotates about a second axis which is positioned vertically below the first axis to agitate coins at a coin pick up position in the hopper bowl; and a dispensing roller is movably positioned above and biased towards the horizontal transport guide portion so that a coin on the horizontal transport guide portion will be pushed against the dispensing roller by one of the coin receiving anchors adjacent the coin release passage, whereby the dispensing roller will urge the coin towards the coin release passage as it passes beneath the dispensing roller;

a single motor; and a gear transmission unit including a drive gear, a transmission gear and a one-way clutch connecting the single motor to drive the rotary disc in one rotational direction and the agitator in the same rotational direction at a different rotational speed.

4. The coin hopper of claim 3 wherein a transmission inner tooth gear is formed on an inside surface of the rotary disc as an operative gear in the gear transmission unit.

5. The coin hopper of claim 3 further including a position adjustment mechanism and a coin sensor mounted on the position adjustment mechanism to monitor the coins dispensed, the position adjustment mechanism includes a slider and a cam member that can adjustably move the slider to position the coin sensor to one of a plurality of positions to sense a particular size coin.

6. The coin hopper of claim 5 further including an unallowable coins blocking piece operatively connected to the slider.

7. The coin hopper of claim 5 further including a handle connected to the cam and means for adjustably retaining the handle to lock the slider at a desired position.

8. The coin hopper of claim 3 wherein the agitator has a plurality of radially extending spaced apart arms, wherein the arms have pointed tips and adjacent surfaces having an inclined coin contact portion on the side of the arms.

9. The coin hopper of claim 3, wherein the rotary disc is provided detachably mounted in the hopper bowl and the fixed guide is also detachably mounted in the hopper bowl to accommodate different size rotary discs and fixed guides to accommodate different size coins.

10. A coin hopper comprising:

a hopper bowl for storing coins in bulk;

a rotary disc having a plurality of coin receiving anchors for receiving and dispensing coins positioned in the hopper bowl, the rotary disk rotates about a first axis that is inclined to a vertical plane;

a fixed guide having a smaller diameter than a rotation path of the coin receiving anchors, the fixed guide is stationarily fixed in the hopper bowl adjacent the rotary disc to support coins as the rotary disc rotates, the fixed guide has a horizontal transport guide portion extending at the top of the fixed guide towards a side of the hopper bowl to translate coins to a coin release passage, the transport guide portion has a thickness equal to or less than the thickness of the stored coins;

an agitator rotates about a second axis which is positioned vertically below the first axis to agitate coins at a coin pick up position in the hopper bowl, wherein the agitator has a plurality of radially extending spaced apart arms, wherein the arms have pointed tips and adjacent surfaces having an inclined coin contact portion on the side of the arms;

a dispensing roller is movably positioned above and biased towards the horizontal transport guide portion so that a coin on the horizontal transport guide portion will be pushed against the dispensing roller by one of the coin receiving anchors adjacent the coin release passage, whereby the dispensing roller will urge the coin towards the coin release passage as it passes beneath the dispensing roller;

a single motor; and a gear transmission unit connected to the single motor that drives the rotary disc in one rotational direction and the agitator in the same rotational direction at a different rotational speed, wherein a transmission inner tooth gear is formed on an inside surface of the rotary disc as an operative gear in the gear transmission unit.

11. The coin hopper of claim 10 further including a position adjustment mechanism and a coin sensor mounted on the position adjustment mechanism to monitor the coins dispensed, the position adjustment mechanism includes a slider and a cam member that can adjustably move the slider to position the coin sensor to one of a plurality of positions to sense a particular size coin.

12. The coin hopper of claim 11 further including an unallowable coins blocking piece operatively connected to the slider.

13. The coin hopper of claim 12 further including a drive gear and a transmission gear for driving the rotary disc, and a one-way clutch is fixed to a central shaft of the transmission gear.

14. The coin hopper of claim 13, wherein the rotary disc is provided detachably mounted in the hopper bowl and the fixed guide is also detachably mounted in the hopper bowl to accommodate different size rotary discs and fixed guides to accommodate different size coins.

15. A coin hopper comprising:

a hopper bowl for storing coins in bulk;

a rotary disc having a plurality of coin receiving anchors for receiving and dispensing coins positioned in the hopper bowl, the rotary disk rotates about a first axis that is inclined to a vertical plane;

a fixed guide having a smaller diameter than a rotation path of the coin receiving anchors, the fixed guide is stationarily fixed in the hopper bowl adjacent the rotary disc to support coins as the rotary disc rotates, the fixed guide has a horizontal transport guide portion extending at the top of the fixed guide towards a side of the hopper bowl to translate coins to a coin release passage, the transport guide portion has a thickness equal to or less than the thickness of the stored coins;

an agitator rotates about a second axis which is positioned vertically below the first axis to agitate coins at a coin pick up position in the hopper bowl;

a dispensing roller is movably positioned above and biased towards the horizontal transport guide portion so that a coin on the horizontal transport guide portion will be pushed against the dispensing roller by one of the coin receiving anchors adjacent the coin release passage, whereby the dispensing roller will urge the coin towards the coin release passage as it passes beneath the dispensing roller;

a single motor; and a gear transmission unit connected to the single motor that drives the rotary disc in one rotational direction and the agitator in the same rotational direction at a different rotational speed, wherein a transmission inner tooth gear is formed on an inside surface of the rotary disc as an operative gear in the gear transmission unit.

16. A coin hopper comprising:

a hopper bowl for storing coins in bulk;

a rotary disc having a plurality of coin receiving anchors for receiving and dispensing coins positioned in the hopper bowl, the rotary disk rotates about a first axis that is inclined to a vertical plane;

a fixed guide having a smaller diameter than a rotation path of the coin receiving anchors, the fixed guide is stationarily fixed in the hopper bowl adjacent the rotary disc to support coins as the rotary disc rotates, the fixed guide has a horizontal transport guide portion extending at the top of the fixed guide towards a side of the hopper bowl to translate coins to a coin release passage, the transport guide portion has a thickness equal to or less than the thickness of the stored coins;

an agitator rotates about a second axis which is positioned vertically below the first axis to agitate coins at a coin pick up position in the hopper bowl, wherein the agitator has a plurality of radially extending space apart arms, wherein the arms have pointed tips and adjacent surfaces having an inclined coin contact portion on the side of the arms;

a dispensing roller is movably positioned above and biased towards the horizontal transport guide portion so that a coin on the horizontal transport guide portion will be pushed against the dispensing roller by one of the coin receiving anchors adjacent the coin release passage, whereby the dispensing roller will urge the coin towards the coin release passage as it passes beneath the dispensing roller;

a single motor; and a gear transmission unit connected to the single motor that drives the rotary disc in one rotational direction and the agitator in the same rotational direction at a different rotational speed.

* * * * *